US009057984B2

(12) United States Patent
Yoshida et al.

(10) Patent No.: US 9,057,984 B2
(45) Date of Patent: Jun. 16, 2015

(54) POWDER CONTAINER, TONER CARTRIDGE, DRAWER TRAY, AND IMAGE FORMING APPARATUS

(75) Inventors: Keiichi Yoshida, Kanagawa (JP); Shunji Katoh, Kanagawa (JP); Hiroshi Ikeguchi, Kanagawa (JP); Shinji Tamaki, Tokyo (JP)

(73) Assignee: RICOH COMPANY, LIMITED, Tokyo (JP)

( * ) Notice: Subject to any disclaimer, the term of this patent is extended or adjusted under 35 U.S.C. 154(b) by 188 days.

(21) Appl. No.: 13/366,456

(22) Filed: Feb. 6, 2012

(65) Prior Publication Data

US 2012/0219318 A1 Aug. 30, 2012

(30) Foreign Application Priority Data

Feb. 25, 2011 (JP) ..... 2011-040033

(51) Int. Cl.
*G03G 15/08* (2006.01)
*G03G 21/16* (2006.01)

(52) U.S. Cl.
CPC ..... *G03G 15/0874* (2013.01); *G03G 15/0886* (2013.01); *G03G 2215/0682* (2013.01); *G03G 2215/0692* (2013.01); *G03G 21/1676* (2013.01)

(58) Field of Classification Search
USPC ..... 399/262; 222/92, 105, 107, DIG. 1
IPC ..... G03G 15/0874,15/0877, 2215/0682, G03G 2215/0692, 21/1676, 15/0886
See application file for complete search history.

(56) References Cited

U.S. PATENT DOCUMENTS

| | | | | |
|---|---|---|---|---|
| 5,249,020 | A * | 9/1993 | Takano | 399/260 |
| 6,091,912 | A | 7/2000 | Kitajima et al. | |
| 6,097,903 | A | 8/2000 | Yahata et al. | |
| 6,151,471 | A | 11/2000 | Yahata et al. | |
| 6,185,401 | B1 | 2/2001 | Kanamori et al. | |
| 6,229,973 | B1 * | 5/2001 | Wang et al. | 399/106 |
| 7,010,250 | B1 * | 3/2006 | Yahagi | 399/258 |
| 7,187,876 | B2 * | 3/2007 | Ito et al. | 399/27 |
| 7,522,851 | B2 | 4/2009 | Koyama et al. | |
| 7,555,249 | B2 * | 6/2009 | Kawai | 399/258 |
| 7,805,098 | B2 * | 9/2010 | Kimura et al. | 399/258 |

(Continued)

FOREIGN PATENT DOCUMENTS

| | | | |
|---|---|---|---|
| CN | 1217490 | A | 5/1999 |
| CN | 1235287 | A | 11/1999 |

(Continued)

OTHER PUBLICATIONS

U.S. Appl. No. 13/247,106, filed Sep. 28, 2011, Yoshida, et al.

(Continued)

*Primary Examiner* — Robert Beatty
(74) *Attorney, Agent, or Firm* — Oblon, McClelland, Maier & Neustadt, L.L.P.

(57) ABSTRACT

A powder container includes: a housing unit that is horizontally elongated, that contains powder, and that has at least part thereof being deformable; and a discharging unit that is attached to one end of the housing unit in a longitudinal direction. The discharging unit includes a discharge opening through which the powder in the housing unit is discharged outside and a rotary shutter that is provided inside the discharge opening and that opens and closes the discharge opening by rotating about a rotating shaft that is arranged perpendicular to the longitudinal direction of the housing unit.

17 Claims, 14 Drawing Sheets

(56) References Cited

U.S. PATENT DOCUMENTS

| | | | | |
|---|---|---|---|---|
| 7,979,009 | B2 * | 7/2011 | Horikawa | 399/258 |
| 8,385,787 | B2 * | 2/2013 | Yamaguchi et al. | 399/258 |
| 8,417,157 | B2 | 4/2013 | Saito et al. | |
| 2007/0237544 | A1 | 10/2007 | Kawai | |
| 2011/0200365 | A1 | 8/2011 | Ikeguchi | |

FOREIGN PATENT DOCUMENTS

| | | | | |
|---|---|---|---|---|
| CN | 1940753 | A | | 4/2007 |
| JP | 05-100562 | | | 4/1993 |
| JP | 6-250574 | | | 9/1994 |
| JP | 11-065246 | | | 3/1999 |
| JP | 11-143195 | | | 5/1999 |
| JP | 2002-46843 | | | 2/2002 |
| JP | 2002-72645 | | | 3/2002 |
| JP | 2005037470 | A | * | 2/2005 |
| JP | 2006-184420 | | | 7/2006 |
| JP | 2006-309147 | | | 11/2006 |
| JP | 2008-134571 | | | 6/2008 |
| JP | 2008-224777 | | | 9/2008 |
| JP | 2009-42567 | | | 2/2009 |
| JP | 2009-53550 | | | 3/2009 |
| JP | 2009-151344 | | | 7/2009 |
| JP | 4401699 | B2 | | 11/2009 |
| JP | 2010-286655 | A | | 12/2010 |
| JP | 2011-022289 | A | | 2/2011 |
| JP | 2011-232540 | | | 11/2011 |

OTHER PUBLICATIONS

Combined Chinese Office Action and Search Report issued Jul. 24, 2013 in Patent Application No. 201210061736.0 (with English language translation).

Office Action mailed Apr. 14, 2014 in Chinese Patent Application No. 201210061736.0 (with English Abstract).

Office Action issued on Jul. 22, 2014 in the corresponding Taiwanese Patent Application No. 101105819 (with English Translation).

* cited by examiner

POWDER CONTAINER, TONER CARTRIDGE, DRAWER TRAY, AND IMAGE FORMING APPARATUS

CROSS-REFERENCE TO RELATED APPLICATIONS

The present application claims priority to and incorporates by reference the entire contents of Japanese Patent Application No. 2011-040033 filed in Japan on Feb. 25, 2011.

BACKGROUND OF THE INVENTION

1. Field of the Invention

The present invention relates to a powder container that contains powder therein, a toner cartridge that uses the powder container, a drawer tray to which the toner cartridge is attached, and an image forming apparatus in which the drawer tray is installed.

2. Description of the Related Art

In electrophotographic image forming apparatuses, such as copying machines, printers, facsimiles, or multifunction peripherals, a toner image is generally formed by a developing device by using a developer, called toner or carrier, so as to form an image. In this type of image forming apparatus, toner is consumed when a image is formed; therefore, a toner cartridge that contains toner is usually attached to the image forming apparatus and, if there is no toner in the cartridge, toner is supplied by replacing the cartridge with a new cartridge.

In one of the methods for attaching a toner cartridge to an image forming apparatus, a drawer tray is used to hold the toner cartridge. The drawer tray is attached to a frame provided on the apparatus body of the image forming apparatus in a horizontally movable manner with respect to the frame. When the drawer tray is moved toward a front side, the drawer tray can be drawn out of the image forming apparatus. Conversely, if the drawer tray is moved toward the apparatus, the drawer tray can be housed in the image forming apparatus. A drawer tray housing unit in the image forming apparatus has a fixing unit to which the toner cartridge is fixed; a sub hopper that temporarily holds toner discharged from the toner cartridge; and the like.

With a toner supply system that uses the above-described toner cartridge, in order to reduce a running cost, there is a user's requirement to use up the toner in the cartridge without leaving any toner therein. In one of the conventional methods that are used for toner cartridges, a screw called an auger is installed in the container and the auger is rotated to deliver toner to a discharging unit. In another conventional method, a container called a screw bottle in which protrusions are formed on the inner surface of the tubular container in a spiral manner is used, and the container is rotated to gradually convey toner to a discharging unit.

However, a conveyance system that uses the above-described auger is disadvantageous because it is necessary to install and rotate a screw in the container, which makes a structure of the conveyance system complex. Furthermore, because the auger forcibly conveys accumulated toner in this conveyance system, a large load is imposed on the toner, which may make the toner clump together or deteriorate. Moreover, installation of a screw in a replaceable container may cause a problem in that a cost for disposables becomes high and an increasing burden is imposed on the environment due to the consumption of resources.

In a conveyance system that uses a screw bottle, because it is not necessary to install a screw in the container, the structure becomes simple. However, because the container is used by being rotated in this conveyance system, the container usually has a shape such that an outlet is provided on one of the sides of the apparatus body of the cylindrical container (the shape of a bottle that is set sideways). Therefore, there are disadvantages in that an amount of toner that can be contained in a cylindrical container is less than that in a container having a shape of a rectangular parallelepiped and in that a cylindrical shape of the container may cause a user's grip to be hard or lost when the container is replaced.

Moreover, because the above-described cartridge or bottle is made of polyethylene terephthalate (PET) forming a PET container called a "hard bottle", causing a serious problem in recycling the used containers associated with the replacement of cartridges or bottles. Specifically, a manufacturer collects used containers from users for reusing, recycling, or thermal disposal; however, because the volumes of used containers are large, logistic costs are high for a manufacturer to collect and convey used containers from users.

Moreover, if a collected container is to be refilled with developer for reusing, cleaning of the collected container is difficult and the efficiency for supplying toner is low; therefore, reusing the collected containers requires high cost.

According to the inventions disclosed in Japanese Patent Application Laid-open No. 2002-46843 and Japanese Patent Application Laid-open No. 2002-72645, a simple horizontally long box container is used, and toner is conveyed to a discharging unit due to the inertia of the toner when the container is moved in a reciprocating manner in the horizontal direction by an external device. According to the invention disclosed in Japanese Patent Application Laid-open No. 2002-72645, a container is made of a flexible material so that the volume of an empty container can be reduced, whereby disposal cost can be reduced. A method for moving a convex portion that is pressed against the bottom of the container is disclosed in Japanese Patent Application Laid-open No. H11-143195 as a method for discharging toner from the above-described flexible container. Another method for discharging toner from a toner container by rotating the shutter of the toner container, thereby the discharging opening thereof is opened or closed is disclosed in Japanese Patent Application Laid-open No. 2006-309147 and Japanese Patent Application Laid-open No. 2009-42567.

In view of the performance for maintenance, such as prevention of contamination due to toner during replacement of a container or easy replacement of a container, if the flexible container disclosed in Japanese Patent Application Laid-open No. 2002-72645 is used, it is preferable to install a shutter in the discharging unit that is provided below the container. However, for the shutter to be opened and closed, a space for moving the shutter is generally needed, and this has been an obstructive factor in the reduction in the space or the size of an image forming apparatus.

Thus, there is a need to provide a powder container and a toner cartridge that prevent powder from leaking out when the toner cartridge is attached or removed and that are suitable for space and size reduction and to provide a drawer tray and an image forming apparatus that use the powder container and the toner cartridge.

SUMMARY OF THE INVENTION

It is an object of the present invention to at least partially solve the problems in the conventional technology.

A powder container includes: a housing unit that is horizontally elongated, that contains powder, and that has at least part thereof being deformable; and a discharging unit that is attached to one end of the housing unit in a longitudinal direction. The discharging unit includes a discharge opening through which the powder in the housing unit is discharged outside and a rotary shutter that is provided inside the discharge opening and that opens and closes the discharge opening by rotating about a rotating shaft that is arranged perpendicular to the longitudinal direction of the housing unit.

A toner cartridge uses the powder container mentioned above.

An image forming apparatus includes the toner cartridge mentioned above in an attachable and detachable manner.

A drawer tray that is horizontally elongated and that causes a toner cartridge to be installed in an image forming apparatus in an attachable and detachable manner includes: a fixing unit that is provided at a front end of the drawer tray and to which a discharging unit of the powder container can be fixed in an attachable and detachable manner; a tilted hole that is formed inside the fixing unit by being tilted downward on a front side and that is connected to a discharge opening of the powder container in a state in which the discharging unit of the powder container is fixed to the fixing unit; a first shutter that is provided at an inlet side of the tilted hole and that can open and close the inlet of the tilted hole; and a second shutter that is provided at an outlet side of the tilted hole and that can open and close the outlet of the tilted hole.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments are explained in detail below with reference to the accompanying drawings. The same or corresponding components are denoted by the same reference marks in each drawing, and duplex explanations are simplified or omitted as appropriate.

Figure 1:
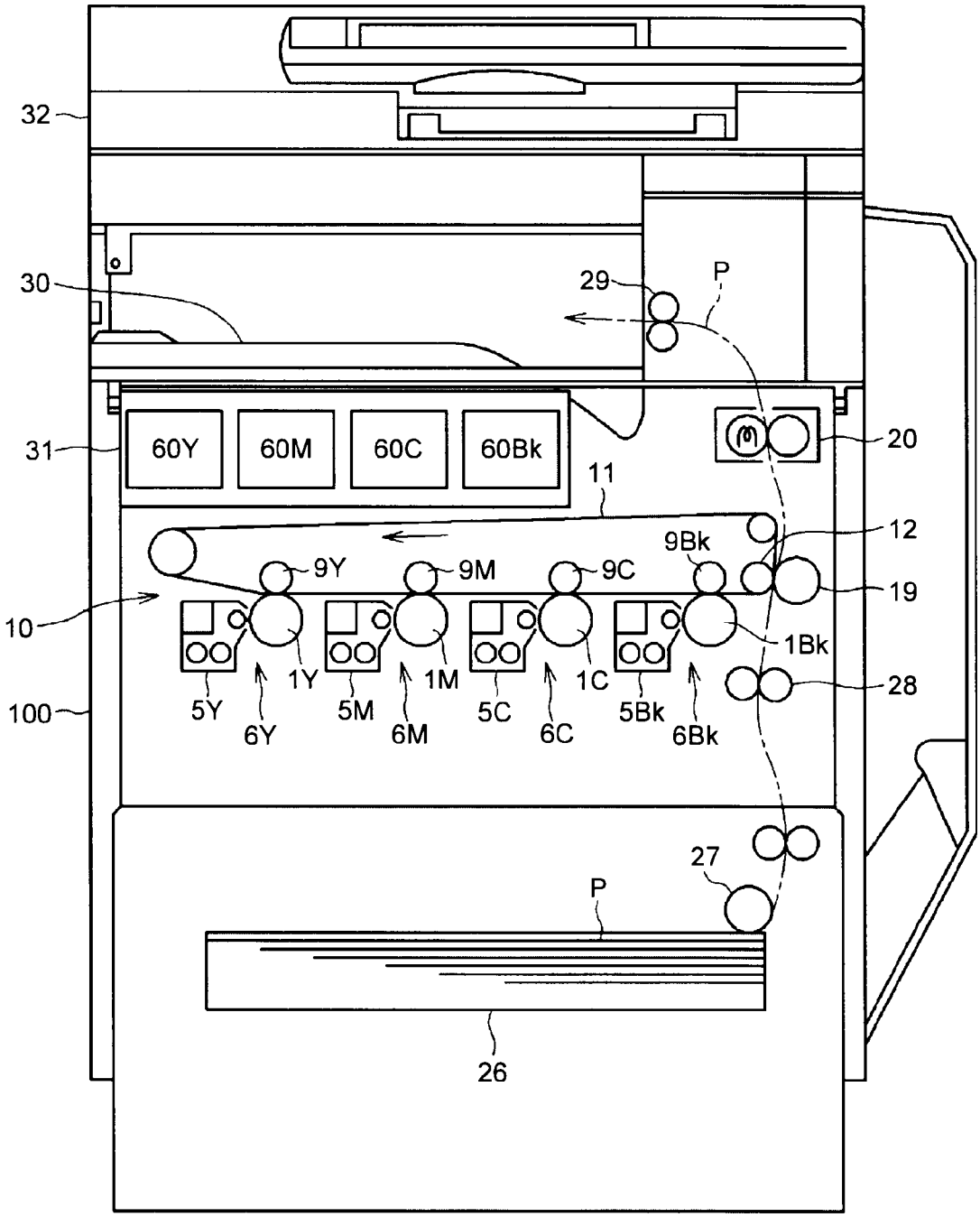
FIG. 1 is a configuration diagram illustrating a printer that is an image forming apparatus according to the embodiment.
Figure 2:
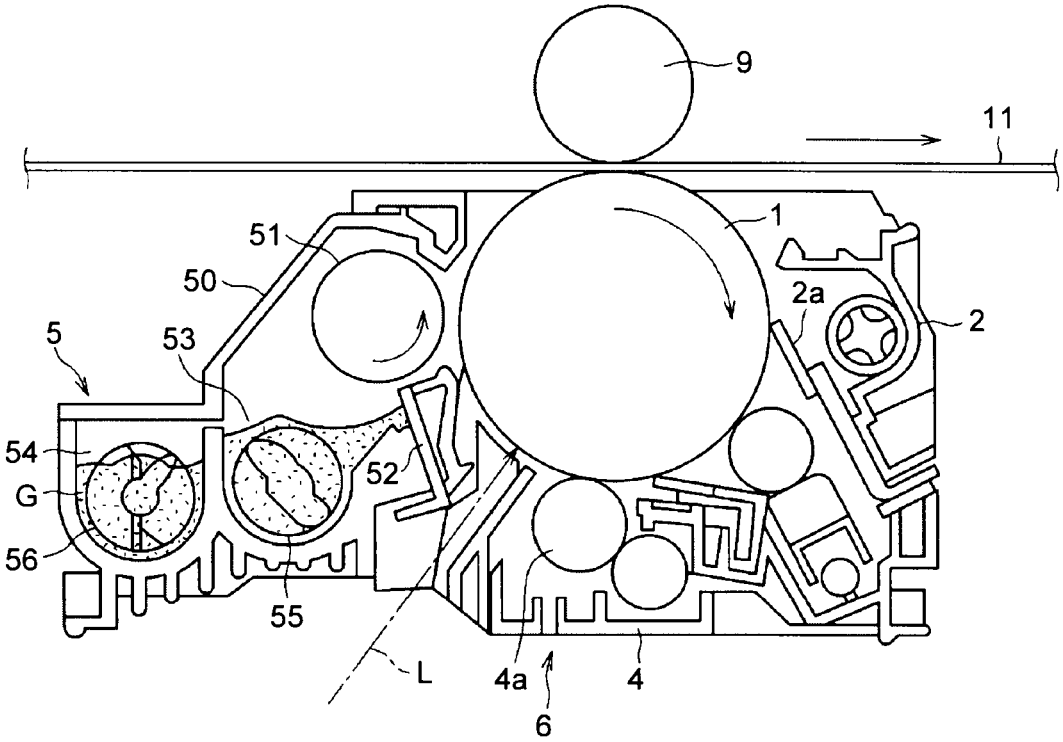
FIG. 2 is an enlarged view illustrating an image forming unit of the image forming apparatus.

First, an explanation is given of the configuration and operation of the overall image forming apparatus with reference to FIGS. 1 and 2.

FIG. 1 is a configuration diagram illustrating a color printer serving as an image forming apparatus, and FIG. 2 is an enlarged view illustrating one of the image forming units in the color printer.

As illustrated in FIG. 1, image forming units 6Y, 6M, 6C, and 6Bk, corresponding to the colors (yellow, magenta, cyan, and black), are arranged side by side so as to be opposed to an intermediate transfer belt 11 of an intermediate transfer unit 10. The four image forming units 6Y, 6M, 6C, 6Bk, which are installed in a apparatus body 100 of an image forming apparatus, have almost the same configuration except that each one has a different color of toner for use in the image forming processes; therefore, an image forming unit 6, a photosensitive element 1, and a primary-transfer bias roller 9 are illustrated in FIG. 2 without using any alphabets (Y, M, C, Bk) in the reference numerals.

As illustrated in FIG. 2, the image forming unit 6 includes the photosensitive element 1 serving as an image carrier; a charging unit 4 that is provided around the photosensitive element 1; a developing device 5 serving as a developing unit; a cleaning unit 2; and the like (only the developing device 5 is illustrated in FIG. 1). The image forming processes (a charging process, exposure process, developing process, transfer process, and cleaning process) are performed on the photosensitive element 1 and a desired toner image is formed thereon.

The photosensitive element 1, the charging unit 4, the developing device 5, and the cleaning unit 2, that are included in the image forming unit 6, are configured such that they can be freely attached to and removed from the apparatus body 100 of the image forming apparatus. Any element that has reached the end of the lifetime can be replaced with a new one.

According to the present embodiment, the photosensitive element 1, the charging unit 4, the developing device 5, and the cleaning unit 2, that are included in the image forming unit 6, are provided as independent units; however, they can be combined together so as to be provided as a process unit that is installed in the apparatus body 100 of the image forming apparatus in a freely attachable and detachable manner. In this case, the operational performance during maintenance of the image forming unit 6 can be improved.

As illustrated in FIG. 2, the developing device 5 includes a developing roller 51 serving as a developer carrier and is opposed to the photosensitive element 1; a doctor blade 52 serving as a developer regulating member that is installed below the developing roller 51; two conveying screws 55, 56 that are developer stirring/conveying members and are provided inside developer containing sections 53, 54, respectively; a case 50 that contains developer G; and the like. Here, two-component developer that includes carrier and toner is used as the developer G. A toner-concentration sensor (not illustrated) for detecting the toner concentration of the developer G is installed in the developing device 5.

The photosensitive element 1 is rotated by a drive unit (not illustrated) in the clockwise direction (the direction of the arrow) in FIG. 2. The surface of the photosensitive element 1 is uniformly charged by a charging roller 4*a* at the position of the charging unit 4 (charging process).

Thereafter, the surface of the photosensitive element 1 reaches the position that is irradiated by laser light L having been emitted by an exposure unit (not illustrated), and an electrostatic latent image is formed by exposure scanning at the position (exposure process).

The surface of the photosensitive element 1 then reaches the position to face the developing roller 51 of the developing device 5, and the electrostatic latent image is developed therein so that a desired toner image is formed (developing process).

Thereafter, the surface of the photosensitive element 1 reaches the position to face the intermediate transfer belt 11 and the primary-transfer bias roller 9, and the toner image formed on the photosensitive element 1 is transferred onto the intermediate transfer belt 11 therein (primary transfer process). A small amount of untransferred toner remains on the photosensitive element 1.

Then, the surface of the photosensitive element 1 reaches the position to face the cleaning unit 2, and the untransferred toner remaining on the photosensitive element 1 is collected by a cleaning blade 2*a* at the position (cleaning process).

Finally, the surface of the photosensitive element 1 reaches the position to face a neutralizing unit (not illustrated), and the residual potential on the photosensitive element 1 is removed therefrom.

Thus, the sequence of image forming processes performed on the photosensitive element 1 is completed.

The above-described image forming processes are performed by each of the four image forming units 6Y, 6M, 6C, and 6Bk. Specifically, in accordance with image information that is read by a reading unit 32 illustrated in FIG. 1, the exposure unit (not illustrated), that is provided below the image forming unit, emits the laser light L (see FIG. 2) toward the photosensitive element 1 in each of the image forming units 6Y, 6M, 6C, and 6Bk.

Specifically, the exposure unit emits the laser light L from a light source, and the photosensitive element 1 is scanned with the laser light L by the rotating polygon mirror through a plurality of optical elements. Thereafter, color toner images having been formed on the respective photosensitive elements 1 after the developing process are transferred onto the intermediate transfer belt 11 in a superimposed manner. Thus, a color image is formed on the intermediate transfer belt 11.

Each of the four primary-transfer bias rollers 9Y, 9M, 9C, 9Bk and the corresponding one of the photosensitive elements 1Y, 1M, 10, 1Bk sandwich the intermediate transfer belt 11 to form a primary transfer nip. A transfer bias that has a polarity opposite to that of the toner is applied to the primary-transfer bias rollers 9Y, 9M, 9C, 9Bk.

The intermediate transfer belt 11 is moved in the direction indicated by the arrow illustrated in the drawing so as to sequentially pass through the primary transfer nips of the primary-transfer bias rollers 9Y, 9M, 9C, 9Bk. Thus, the color toner images on the respective photosensitive elements 1Y, 1M, 10, 1Bk are primarily transferred onto the intermediate transfer belt 11 in a superimposed manner.

Afterward, the intermediate transfer belt 11, onto which the color toner images have been transferred in a superimposed manner, reaches the position where the intermediate transfer belt 11 faces a secondary transfer roller 19. At the position, the intermediate transfer belt 11 is sandwiched between a secondary-transfer backup roller 12 and the secondary transfer roller 19 to form a secondary transfer nip therebetween. The color toner image formed on the intermediate transfer belt 11 is transferred onto a transfer material P, such as a transfer sheet, which has been conveyed to the position of the secondary transfer nip. At this time, untransferred toner that has not been transferred onto the transfer material P remains on the intermediate transfer belt 11; however, the residual toner on the intermediate transfer belt 11 is removed by a belt cleaning device (not illustrated).

Thus, a series of transfer processes performed on the intermediate transfer belt 11 is completed.

The transfer material P is conveyed from a feed unit 26 provided in the lower portion of the apparatus body 100 of the image forming apparatus to the position of the secondary transfer nip via a feed roller 27, a pair of registration rollers 28, and the like.

Specifically, the feed unit 26 stores a plurality of transfer materials P, such as transfer sheets, in a stacked manner. When the feed roller 27 is rotated in the counterclockwise direction in FIG. 1, a top piece of the transfer material P is fed toward a gap between the registration rollers 28.

The transfer material P that has been conveyed to the pair of registration rollers 28 is temporarily stopped at the position of the roller nip of the registration rollers 28 that have stopped rotating. Then, the pair of registration rollers 28 is rotated in synchronized timing with the color image formed on the intermediate transfer belt 11, so that the transfer material P is conveyed toward the secondary transfer nip. Thus, a desired color image is transferred onto the transfer material P.

Thereafter, the transfer material P, onto which the color image has been transferred at the position of the secondary transfer nip, is conveyed to the position of a fixing unit 20. At that position, the color image that has been transferred onto the surface of the transfer material P is fixed to the transfer material P due to the heat and pressure applied by a fixing roller and a pressure roller, respectively.

The transfer material P is then conveyed through the gap between a pair of discharge rollers 29 and is discharged from the apparatus. The transfer material P, which has been discharged from the apparatus body 100 of the image forming apparatus by the pair of discharge rollers 29, is sequentially stacked on a stack section 30 as an output image.

Thus, a series of image forming processes performed by the image forming apparatus is completed.

As illustrated in FIG. 1, a toner supply section 31 is provided above the intermediate transfer unit 10. The toner supply section 31 includes four toner supply devices 60Y, 60M, 60C, 60Bk, each of which is filled with toner of the corresponding color. A toner conveyance path extends from each of the toner supply devices 60Y, 60M, 60C, 60Bk to the corresponding developing device 5Y, 5M, 5C, 5Bk. The toner supply devices 60Y, 60M, 60C, 60Bk supply toner to the developing devices 5Y, 5M, 5C, 5Bk, respectively, via the toner conveyance paths. Thus, it is possible to supply new toner to the developing devices 5Y, 5M, 5C, 5Bk in accordance with the toner consumptions of the developing devices 5Y, 5M, 5C, 5Bk and to use the developing devices for a long term.

The above-described four toner supply devices 60Y, 60M, 60C, 60Bk have the same configuration with the difference in the colors of the toner. In the following, an explanation is given of the configuration of one of the toner supply devices.

Figure 3:
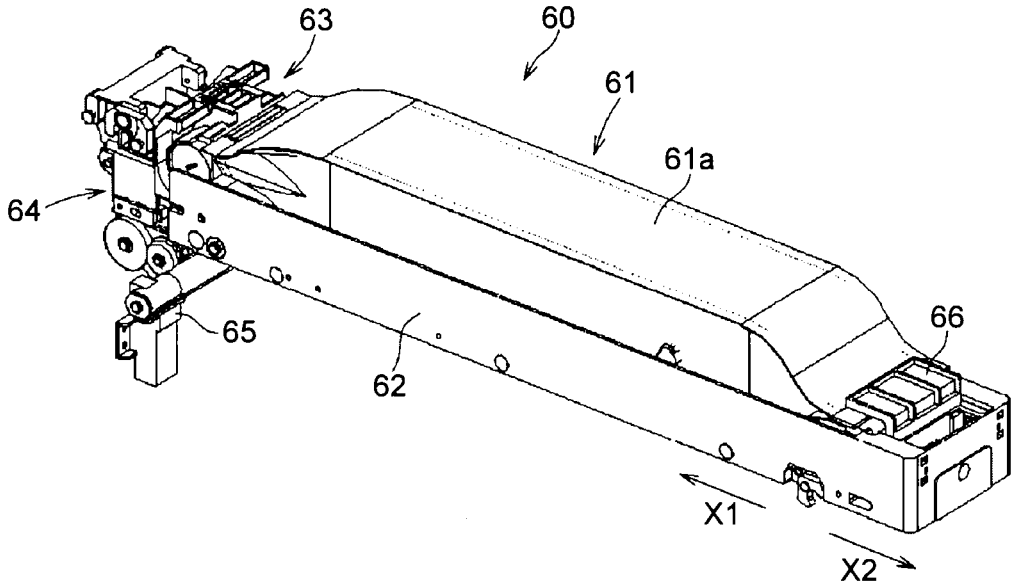
FIG. 3 is a perspective view of a drawer tray.

FIG. 3 is a perspective view of the toner supply device 60. The alphabets (Y, M, C, Bk) are omitted from the reference numeral used to refer to the toner supply devices 60 in FIG. 3.

The toner supply device 60 includes a toner cartridge 61 that contains toner that is powder; a drawer tray 62 to which the toner cartridge 61 is attached; a front fixing unit 63 that is provided on the front end of the drawer tray 62 and to which a front-end discharging unit 61*c* of the toner cartridge 61 is fixed; a vibrating unit 64 that is provided on the side of the apparatus body 100 of the image forming apparatus; and a sub hopper 65 that is connected to the lower side of the vibrating unit 64.

When the drawer tray 62, on which the toner cartridge 61 is mounted, is moved in the direction indicated by the arrow X1 in FIG. 3 and is attached to the apparatus body 100, the front fixing unit 63 of the drawer tray 62 is connected to the vibrating unit 64. The toner cartridge 61 is connected to the front fixing unit 63 when the toner cartridge 61 is placed on the drawer tray 62, and when the drawer tray 62 is attached to the apparatus body 100, the toner cartridge 61 is indirectly connected and fixed to the vibrating unit 64.

Figure 9A:
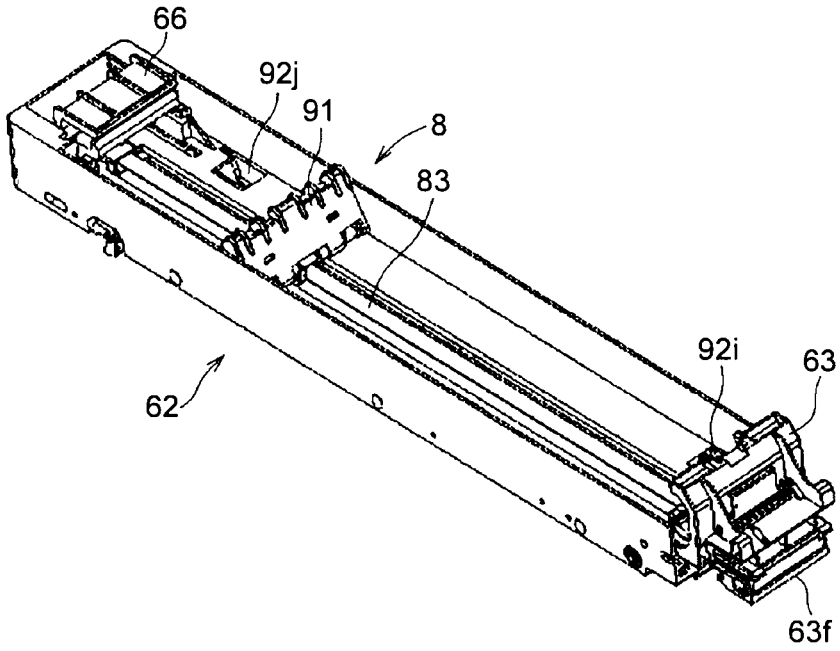
FIG. 9A is a perspective view of the drawer tray when seen from the front side.
Figure 9B:
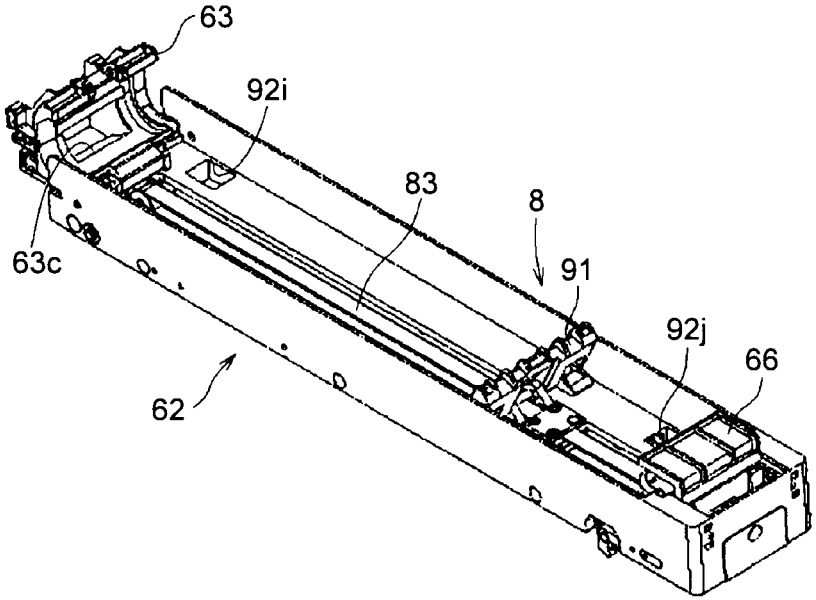
FIG. 9B is a perspective view of the drawer tray when seen from the back side.

A toner conveying device 8 is provided on the drawer tray 62, as illustrated in FIGS. 9A and 9B. A delivery member 91 of the toner conveying device 8 makes a swell deformation on the bottom portion of the toner cartridge 61 so that the toner in the toner cartridge 61 is conveyed forward and discharged into the front fixing unit 63. The discharged toner further passes through the vibrating unit 64 and, while being subjected to the fall-accelerating action by the vibration of the vibrating unit 64, drops to the sub hopper 65 due to the own weight. The sub hopper 65 includes a conveying screw, a sheet-like agitator, or the like, and the toner is supplied from the sub hopper 65 to the developing device 5.

Figure 4:
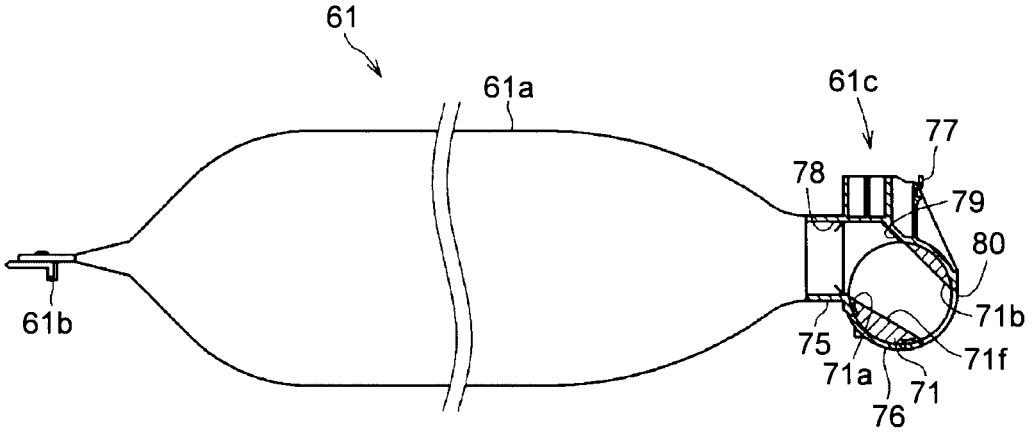
FIG. 4 is a cross-sectional side view of a toner cartridge.
Figure 5A:
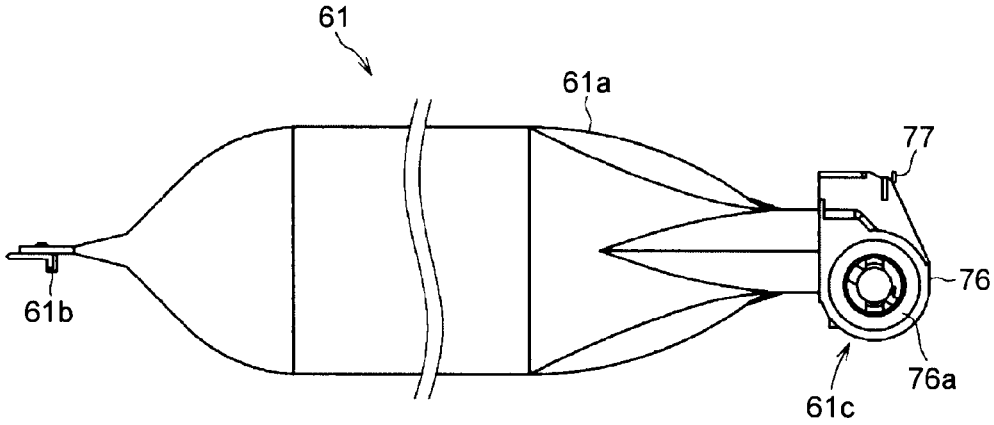
FIG. 5A is a side view of the toner cartridge.
Figure 5B:
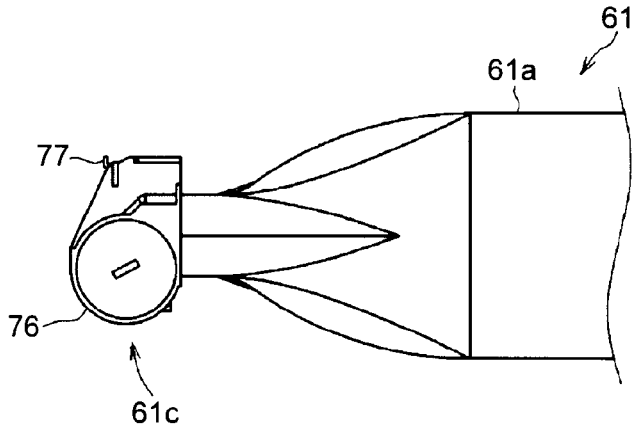
FIG. 5B is a side view of the front end of the toner cartridge.
Figure 5C:
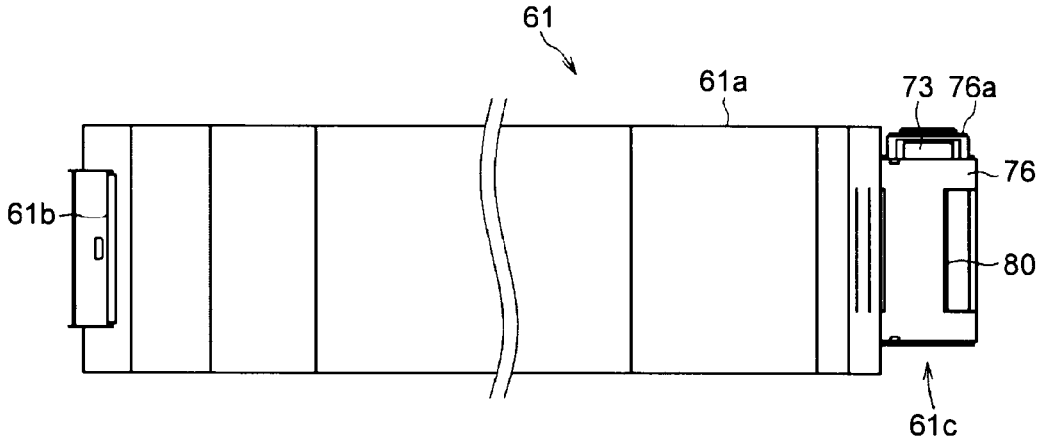
FIG. 5C is a bottom view of the toner cartridge.

FIGS. 4 to 5C are configuration diagrams of the toner cartridge 61. FIG. 4 is a cross-sectional side view of the toner cartridge, FIG. 5A is a side view of the toner cartridge 61, FIG. 5B is a side view of the front end of the toner cartridge 61, and FIG. 5C is a bottom view of the toner cartridge 61.

As illustrated in FIG. 4, the toner cartridge 61 includes a housing unit 61*a*, a locking section 61*b*, and a discharging unit 61*c*. The housing unit 61*a* is formed by bonding four films of resin or four pieces of paper so as to obtain a flexible horn-shaped tubular bag. The housing unit 61*a* may be formed by center-folding a sheet and joining the three sides of the folded sheet so as to obtain a horn-shaped tubular bag, such as a confectionery bag or tea bag. The inside dimensions of the housing unit 61*a* are, for example, 60 mm in height, 60 mm in width, and 400 mm in length. The toner cartridge 61 with such a size can contain about 500 g of toner.

The housing unit 61*a* may be transparent, translucent, or opaque and is made of resin, such as polyethylene or nylon, or paper in a single layer structure or multilayer structure. Specifically, various resin films may be used alone or in combination, such as PA (polyamide resin, nylon), PE (high-density polyethylene (HDPE), low-density polyethylene (LDPE), PC (polycarbonate resin), PP (polypropylene), PS (polystyrene resin), PAN (polyacrylonitrile resin), PET (polyester resin), PVC (polyvinyl chloride resin), or PVDC (polyvinylidene chloride resin).

According to the present embodiment, flexible materials, for example, four types of resin films, PP, PET, PA, and LDPE are sequentially bonded to one another and used for the housing unit 61*a* (LDPE is used in the innermost layer). At least the inner wall area of the housing unit 61*a* is made of polyethylene so that the heat-sealing property of the housing unit 61*a* can be improved when the housing unit 61*a* is connected to the discharging unit 61*c* by heat sealing. The housing unit 61*a* can be painted in the same color as that of the developer to be contained therein as necessary. A thin film that increases the abrasion resistance or decreases the coefficient of friction can be formed on the surface layer by using various methods such as physical vapor deposition (PVD) or chemical vapor deposition (CVD). A mechanism can be provided to apply various antifriction materials so that the friction with the delivery member 91, to be described later, can be reduced.

The locking section 61*b* is provided on the rear end of the housing unit 61*a* so that the locking section 61*b* is attached to a rear fixing unit 66 that is provided on the rear end of the drawer tray 62. The locking section 61*b* is made of hard resin that is harder than that of the housing unit 61*a*. The discharging unit 61*c* is provided on the front end of the housing unit 61*a*, and the powder in the housing unit 61*a* is discharged to the outside through the discharging unit 61*c*. The discharging unit 61*c* is made of a hard resin, or the like, that is harder than that of the housing unit 61*a*. The discharging unit 61*c* includes a ferrule 75, a tubular section 76, and a protruding portion 77. The ferrule 75 has a horizontally elongated rectangular opening, and the ferrule 75 is inserted into the discharge opening of the housing unit 61*a* and is subjected to thermal welding. The tubular section 76 has a horizontally elongated shape and is provided to in a direction perpendicular to the ferrule 75, and the protruding portion 77 is formed on the upper portion of the tubular section 76.

Discharge holes, through which the toner in the housing unit 61*a* is discharged to the outside, are formed in the ferrule 75 and the tubular section 76. The discharge holes are formed by a horizontal hole 78 and an tilted hole 79: the horizontal hole 78 has a horizontally elongated rectangular shape and is connected in a substantially horizontal manner to the discharge opening at one end of the housing unit 61*a*; the tilted hole 79 is tilted downward toward the front and is connected to the horizontal hole 78 by roughly keeping the cross-sectional shape thereof. It is preferable that the tilt angle of the tilted hole 79 with respect to the horizontal plane is set to be greater than or equal to 10° so that the toner can flow in a smooth manner.

Figure 7:
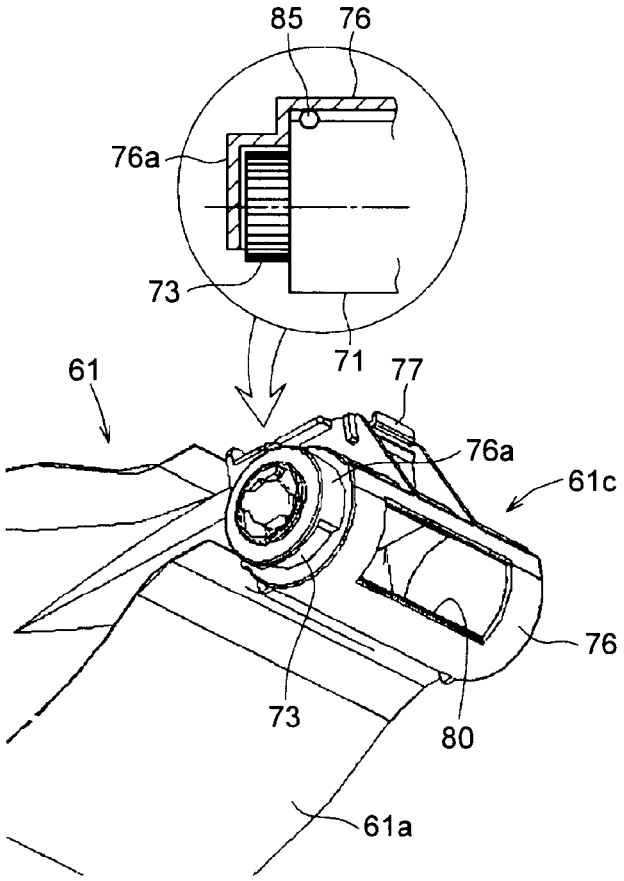
FIG. 7 is a perspective view of the front end of the toner cartridge when the rotary shutter is in the open state.

As illustrated in FIG. 7, the lower end of the tilted hole 79 is opened to form a horizontally elongated discharge opening 80 that is provided on the outer circumference of the tubular section 76 and is at an obliquely downward position. Because the discharge opening 80 is directed obliquely downward, toner can drop through the discharge opening 80 by means of gravity and can be delivered to the sub hopper in a smooth manner, thereby simplifying the structure for discharging the toner.

If the section size of the housing unit 61*a* is, for example, about 60 mm in height and about 60 mm in width at a maximum in the middle area, the entire toner cartridge including the discharging unit 61*c* can be made compact by reducing the size of the area for connecting to the discharging unit 61*c* to, for example, about 20 mm in height and about 40 mm in width.

Figure 8A:
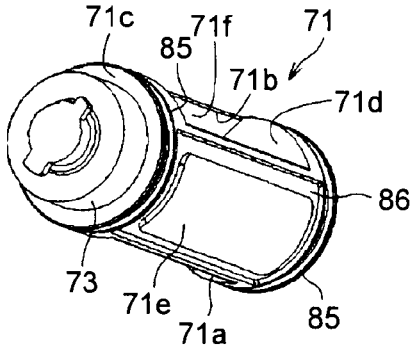
FIG. 8A is a perspective view of the rotary shutter at a closed position.
Figure 8B:
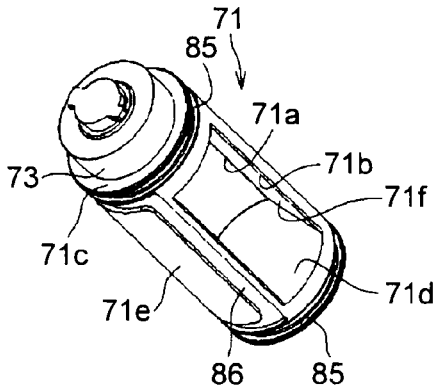
FIG. 8B is a perspective view of the rotary shutter at an open position.

A rotary shutter 71 having a cylindrical shape is provided inside the tilted hole 79, as illustrated in FIGS. 8A and 8B. The entirety of the rotary shutter 71 has a cylindrical shape that is slightly smaller than the tubular section 76 and the rotary shutter 71 is provided to be rotatable about the central axis of the tubular section 76 in a coaxial manner. As illustrated in FIGS. 8A and 8B, the rotary shutter 71 includes a first circular side plate 71*c* and a second circular side plate 71*d* that are provided on the right and left sides of the rotary shutter 71 in FIGS. 8A and 8B, respectively; and a cylindrical circumferential wall 71*e* that connects the first and second circular side plates 71*c* and 71*d*. An inlet 71*a* and an outlet 71*b*, both of which have horizontally elongated rectangular shapes, are formed on part of the circumferential wall 71*e* at the positions where the inlet 71*a* and the outlet 71*b* are located on the opposite sides to each other with respect to the central axis of the rotary shutter 71. Each of the inlet 71*a* and the outlet 71*b* has an opening with a central angle of about 90° and has substantially the same cross-sectional shape as the tilted hole 79 and the discharge opening 80. The inlet 71*a* and the outlet 71*b* pass over the rotary shutter 71 along a diameter and connect to a horizontally elongated rectangular through-hole 71*f* that is part of the discharge opening. Because the central angle of the inlet 71*a* is slightly larger than that of the outlet 71*b*, the through-hole 71*f* has a shape that is gradually tapered from the inlet 71*a* to the outlet 71*b*. At the rotation position where the inlet 71*a* and the outlet 71*b* correspond to the tilted hole 79 and the discharge opening 80, as illustrated in FIG. 4, the tilted hole 79, the inlet 71*a*, the through-hole 71*f*, the outlet 71*b*, and the discharge opening 80 form a discharge path that is tilted downward toward the front and continues in a linear fashion. In this state, the inner wall of the through-hole 71*f* of the rotary shutter 71 becomes an tilted surface that is tilted downward toward the front, and the tilted surface on the side of the inlet 71*a* is provided at a position with the height equal to or lower than the height of the bottom surface of the horizontal hole 78, so that a continuous discharge path is formed from the housing unit 61*a* to the discharge opening 80. Thus, the toner flows in a smooth manner. It is preferable that, when toner is discharged, the tilt angle of the inner wall of the rotary shutter 71 is, similarly to the case of the tilted hole 79 described above, set to be greater than or equal to 10°.

As illustrated in FIGS. 8A and 8B, the rotary shutter 71 includes a gear 73 that is provided on one of the side surfaces of the rotary shutter 71. The gear 73 is formed integrally on an exterior-side surface of the first circular side plate 71*c* in a concentric fashion with the center of the first circular side plate 71*c*. The diameter of the first circular side plate 71*c* is made to be slightly larger than that of the gear 73, and the gear 73 protrudes outwardly from one side of the tubular section 76. The exterior-side surface and the upper portion in the outer circumference of the gear 73 are covered with a cover 76*a* that is formed integrally with the tubular section 76. As illustrated in FIG. 7, the teeth of the gear 73 on the lower circumference are exposed to the outside through a cutout of the cover 76*a*. Thus, when the toner cartridge 61 is attached to the apparatus body 100, there is no possibility that the gear 73 is brought into contact with a surrounding component and gets damaged.

Figure 6A:
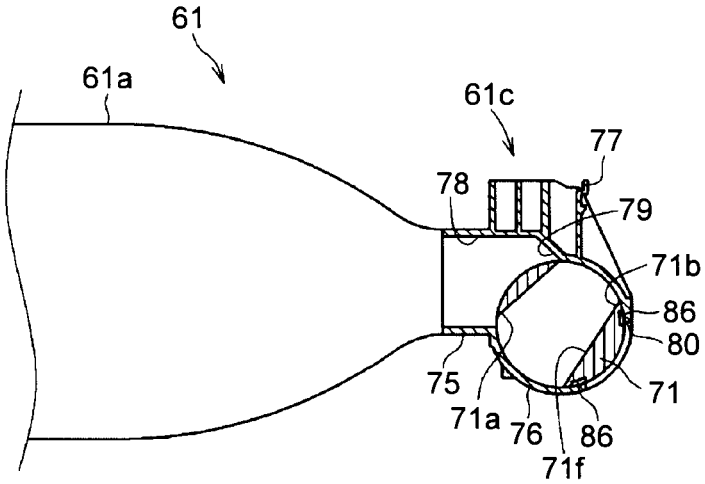
FIG. 6A is a cross-sectional side view of the front end of the toner cartridge when a rotary shutter is in a closed state.

An O-ring 85 is fitted to the outer circumference on both ends, in an axial direction, of the rotary shutter 71. A rectangular sponge seal 86 is attached to an area of the circumferential wall 71*e* of the rotary shutter 71 other than the inlet 71*a* and the outlet 71*b*. The O-ring 85 seals the gap between the inlet 71*a* and the outlet 71*b* in the axial direction, and the sponge seal 86 seals the gap that continues from the discharge opening 80 to the internal tilted hole 79 when the discharge opening 80 is closed by the rotary shutter 71, as illustrated in FIG. 6A. The sealing structures that use the O-ring 85 and the sponge seal 86 are cost-effective because these components can be purchased at low cost. According to another embodiment of the sealing structure, elastomer having a shape for connecting all the O-ring 85 and the sponge seal 86 can be used. In this case, double integral molding can be applied to make it unnecessary to attach seals, so that the assembly costs can be reduced and the manufacturing variations in assemblies can be decreased.

Figure 6B:
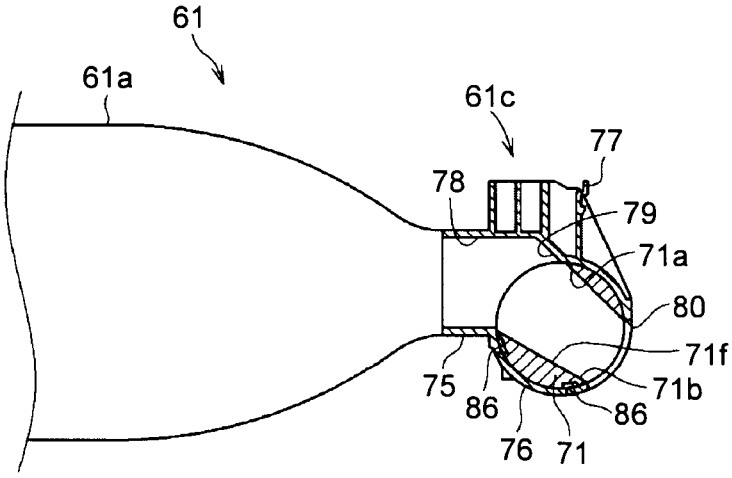
FIG. 6B is a cross-sectional side view of the front end of the toner cartridge when the rotary shutter is in an open state.

As illustrated in FIG. 6A, in the rotary shutter 71, when the through-hole 71*f* serving as an internal path is directed obliquely upward, the outlet 71*b* is at the closed position where the positions of the outlet 71*b* and the discharge opening 80 of the tubular section 76 do not coincide with each other and, as illustrated in FIG. 6B, when the through-hole 71*f* is directed obliquely downward, the outlet 71*b* is at the open position where the positions of the outlet 71*b* and the discharge opening 80 of the tubular section 76 coincide with each other. The rotation angle from the closed position illustrated in FIG. 6A to the open position illustrated in FIG. 6B is about 90°.

Figure 10:
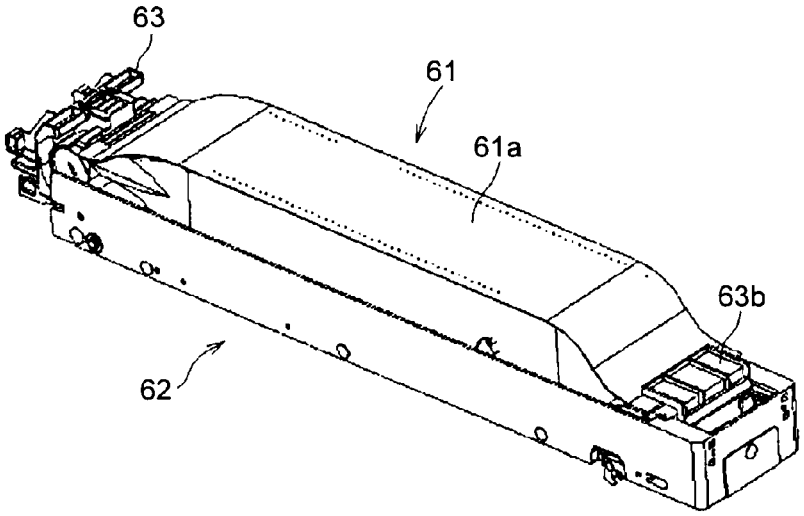
FIG. 10 is a perspective view of the drawer tray in which the toner cartridge is installed.
Figure 12:
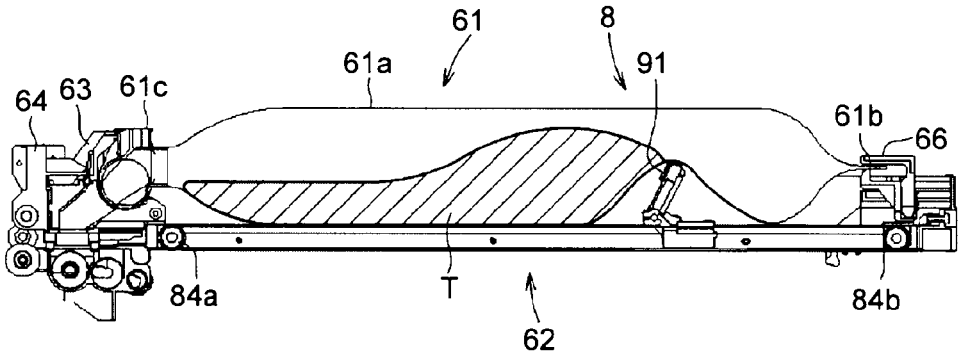
FIG. 12 is a cross-sectional side view of the drawer tray that includes the toner cartridge.

As illustrated in FIGS. 9A and 9B, the drawer tray 62 is a rectangular box that has an opening on the top side. The drawer tray 62 is movably installed on the frame of the apparatus body 100 of the image forming apparatus. The toner cartridge 61 is attached to the drawer tray 62, as illustrated in FIG. 10, and the drawer tray 62 is moved in the direction of the arrow X1, as illustrated in FIG. 3, so as to be housed in the apparatus body 100 or is moved in the direction of the arrow X2 so as to be drawn out of the apparatus body 100. FIG. 12 illustrates a state where the drawer tray 62, to which the toner cartridge 61 is attached, is installed in the apparatus body 100. The toner conveying device 8 is provided inside the drawer tray 62 to convey the toner T in the toner cartridge 61 forward. The toner conveying device 8 includes the delivery member 91 that is provided on the bottom portion of the drawer tray 62 and in sliding contact with the bottom portion of the toner cartridge 61; and a drive belt 83 that moves back and forth the delivery member 91.

Figure 11A:
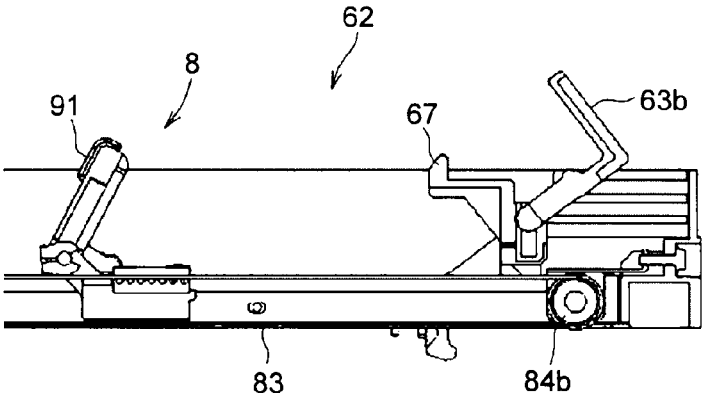
FIG. 11A is a side view of the rear section of the drawer tray when a rear fixing unit of the toner cartridge is in an open state.
Figure 11B:
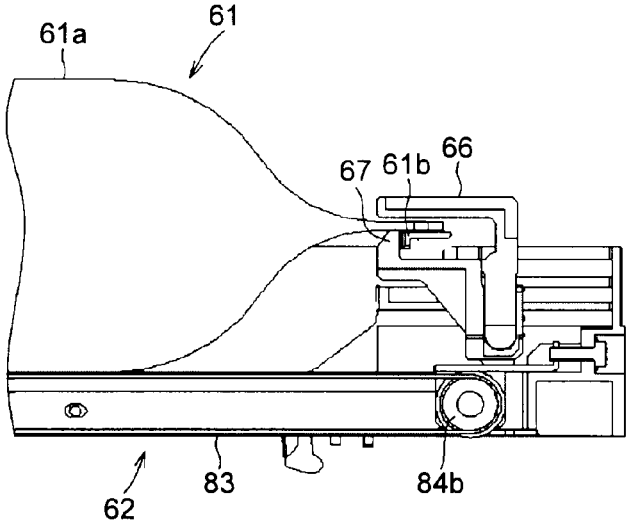
FIG. 11B is a side view of the rear section of the drawer tray when the rear fixing unit of the toner cartridge is in a closed state.
Figure 14:
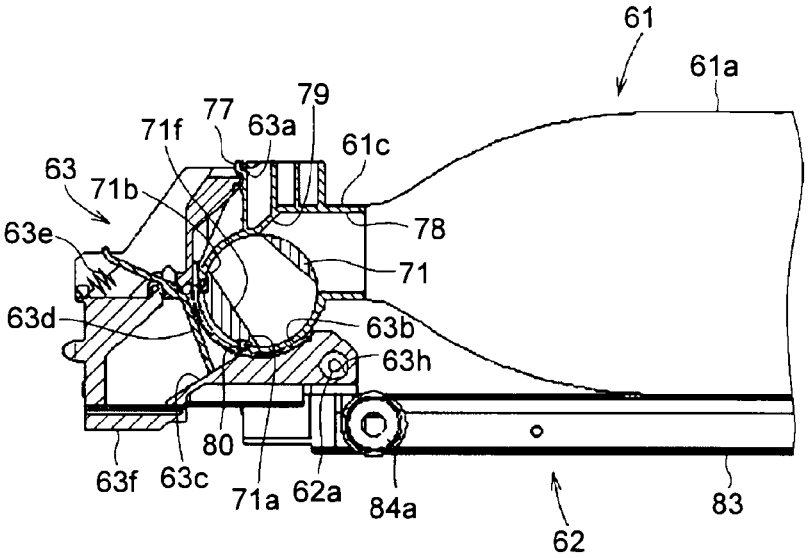
FIG. 14 is a side view of the front end of the drawer tray in which the toner cartridge is installed.

As illustrated in FIG. 12, the front fixing unit 63 and the rear fixing unit 66 are provided on the front and rear ends of the drawer tray 62, respectively so as to fix the front and rear ends of the toner cartridge 61 and to prevent the toner cartridge 61 from moving back and forth due to the sliding contact of the toner cartridge 61 with the delivery member 91. As illustrated in FIG. 14, the front fixing unit 63 engages with the protruding portion 77 in the discharging unit 61*c* of the toner cartridge 61. The rear fixing unit 66 is rotated from the open state illustrated in FIG. 11A to the closed state illustrated in FIG. 11B so as to fix the locking section 61*b* of the toner cartridge 61. That is, the toner cartridge 61 is attached to the drawer tray 62 in the open state illustrated in FIG. 11A, the locking section 61*b* of the toner cartridge 61 is placed on a fixing board 67, as illustrated in FIG. 11B, and the rear fixing unit 66 presses the locking section 61*b* from above. When the drawer tray 62 is drawn out of the apparatus body 100, the rear fixing unit 66 moves forward for a predetermined distance together with the fixing board 67 in conjunction with the drawer operation and the rear fixing unit 66 shifts to the open state illustrated in FIG. 11A. Thus, the toner cartridge 61 can be taken out. Conversely, when the toner cartridge 61 is installed on the drawer tray 62 and the drawer tray 62 is moved toward the apparatus body 100, the rear fixing unit 66 shifts to the closed state illustrated in FIG. 11B in conjunction with the above operation and moves for a predetermined distance together with the fixing board 67 in the direction in which the toner cartridge 61 is drawn. The rear fixing unit 66 and the fixing board 67 are always urged to move backward by a spring that is provided on the rear side of the drawer tray 62 and are configured to move in a horizontal direction while always applying tension to the toner cartridge 61.

Figure 13:
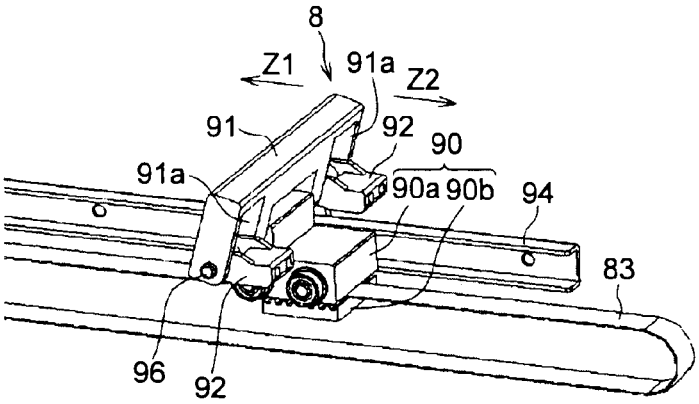
FIG. 13 is a perspective view of a toner conveying device.

As illustrated specifically in FIG. 13, the toner conveying device 8 includes a base member 90; the delivery member 91 and a pair of leg members 92 that are attached to the base member 90; the drive belt 83 that is a drive unit for moving the base member 90; a pair of guide rails 94 serving as a guide member that guides the base member 90; and the like. The guide rail 94 on the front side is not illustrated in FIG. 13.

The base member 90 is separated into an upper portion 90*a* and a lower portion 90*b*. The drive belt 83 is sandwiched between the upper portion 90*a* and the lower portion 90*b*, thereby attaching the base member 90 to the drive belt 83. The drive belt 83 is configured as an endless belt and extends between two rollers 84*a*, 84*b* that are provided on the drawer tray 62. A driving force is transmitted from a transmission gear in the apparatus body 100 to the roller 84*a* on the front side so that the drive belt 83 can rotate in backward and forward directions. Thus, the drive belt 83 rotates in a forward or backward direction so that the base member 90 and the delivery member 91 and the leg members 92, which are attached to the base member 90, can move backward and forward together in a delivery direction Z1, which is the direction toward the discharging unit 61*c*, and in a return direction Z2, which is the direction opposite to the delivery direction Z1.

Furthermore, as illustrated in FIG. 13, the delivery member 91 and the leg members 92 are attached to each other via a support shaft 96, which extends in the horizontal direction, in such a manner that the delivery member 91 and the leg members 92 can be opened and closed with respect to each other. Specifically, the delivery member 91 and the leg members 92 are configured to be able to rotate about the support shaft 96 independently of each other. Thus, the delivery member 91 or the leg members 92 can rotate about the support shaft 96 so that the delivery member 91 and the leg members 92 are opened and closed with respect to each other. The delivery member 91 and the leg members 92 are urged by a torsion coil spring (not shown), which is an urging member, in a direction to separate the delivery member 91 and each one of the leg members 92 from each other. Furthermore, recessed housing portions 91*a* are formed on the delivery member 91 to house the leg members 92 when the leg members 92 are closed.

FIG. 14 illustrates a state where the protruding portion 77 of the toner cartridge 61 is fixed to the front fixing unit 63 of the drawer tray 62. The front fixing unit 63 includes an engagement hole 63*a* with which the protruding portion 77 of the discharging unit 61*c* in the toner cartridge 61 engages; a circular section 63*b* that covers an area of the tubular section 76 from the front side to the lower side of the tubular section 76; an tilted hole 63*c* that opens to the circular section 63*b* and corresponds to the discharge opening 80 of the toner cartridge 61; a first shutter 63*d* that is rotatable and is provided at the inlet of the tilted hole 63*c*; a tension spring 63*e* that urges the first shutter 63*d* to move in a closed direction; a second shutter 63*f* that is slidable and is provided at the outlet of the tilted hole 63*c*; and a connection hole 63*h* into which a connection shaft 62*a* of the drawer tray 62 is loosely inserted. The second shutter 63*f* is drawn by a spring (not shown) and is usually closed.

As illustrated in FIG. 14, the rotary shutter 71 of the toner cartridge 61 is closed when the new toner cartridge 61 is installed in the drawer tray 62, which is drawn out of the apparatus body 100 or immediately before the used toner cartridge 61 is removed from the drawer tray 62, which has been drawn out of the apparatus body 100. The first shutter 63*d* and the second shutter 63*f* in the fixing unit are also closed. Therefore, when the drawer tray 62 is attached to or removed from the apparatus body 100, there is no possibility of external leakage of the toner in the toner cartridge 61 and residual toner that adheres to the tilted hole 63*c* of the front fixing unit 63. Furthermore, there is no possibility that foreign substance enters the tilted hole 63*c* while the toner cartridge 61 is removed from the front fixing unit 63.

Figure 15:
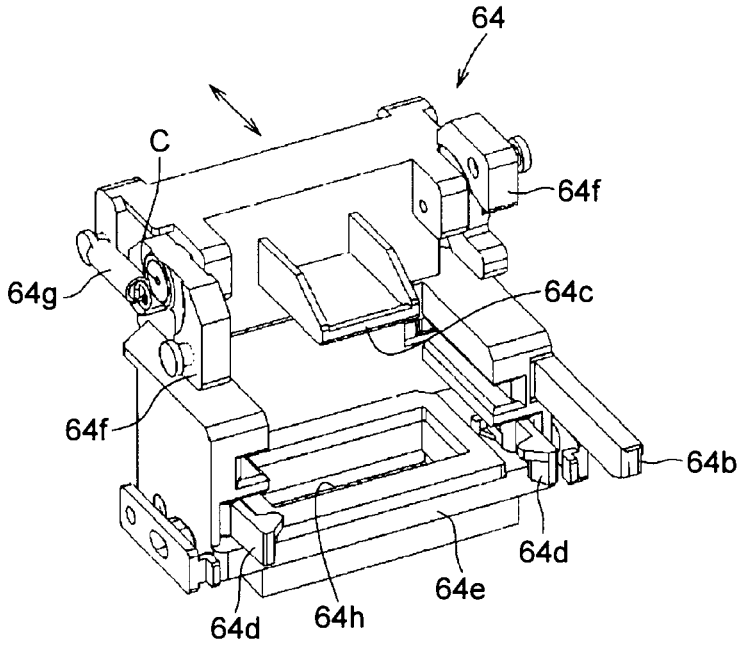
FIG. 15 is a perspective view of a vibrating unit.
Figure 16:
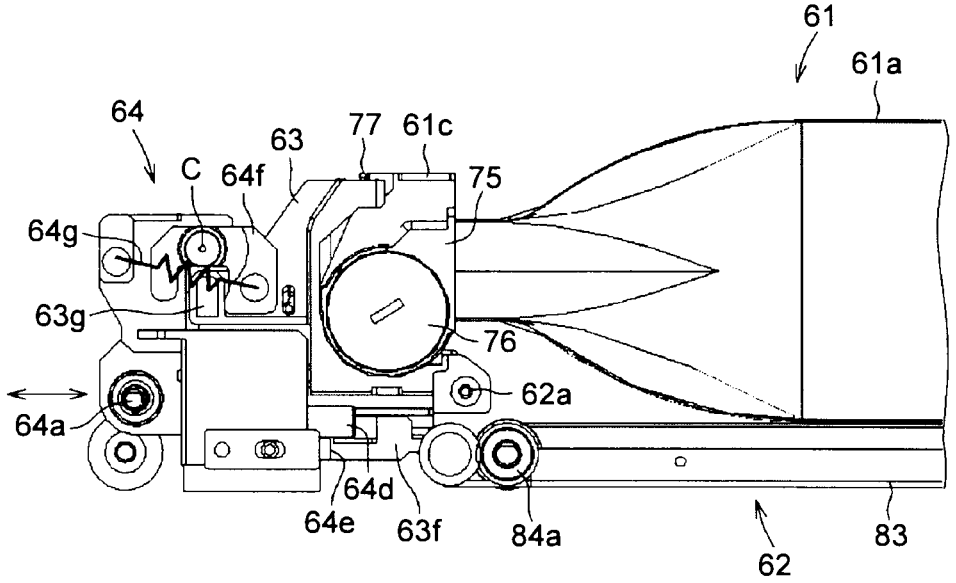
FIG. 16 is a side view of the vibrating unit to which the drawer tray is attached.
Figure 18:
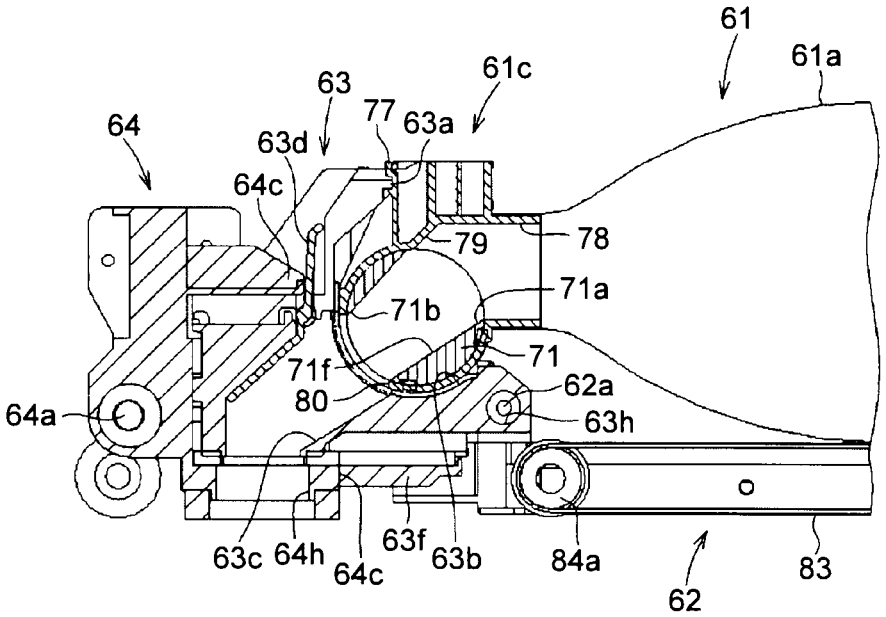
FIG. 18 is a cross-sectional side view of the vibrating unit to which the drawer tray is attached.

FIG. 15 illustrates, as a single unit, the vibrating unit 64 on the side of the apparatus body 100. As illustrated in FIG. 16, an eccentric shaft 64*a*, that passes through an appropriate position in the frame of the vibrating unit 64, is rotated by an motor (not illustrated) that is provided on the side of the apparatus body 100, whereby the frame, through which the eccentric shaft 64*a* passes, is vibrated in backward and forward directions (the directions indicated by the arrow). The eccentric shaft 64*a* is configured such that the middle area thereof is slightly eccentric with respect to both ends thereof, and the vibration due to the rotation of the eccentric shaft 64*a* is transmitted to the front fixing unit 63 of the drawer tray 62 via lock arms 64*f*, which will be described later, whereby the discharge of toner is expedited. As illustrated in FIGS. 14 and 18, the connection shaft 62*a*, that connects the front fixing unit 63 with the drawer tray 62, loosely passes through the connection hole 63*h* in the front fixing unit 63 so that the connection shaft 62*a* is not in direct contact with the connection hole 63*h*; therefore, vibration of the vibrating unit 64 is prevented from influencing the image quality by transmitting the vibration from the vibrating unit 64 to the drawer tray 62 and further to the developing device 5.

The vibrating unit 64 includes a rack bar 64*b* that protrudes toward the drawer tray 62 and has a rack formed on the top surface to be engaged with the gear 73; a protruding portion 64*c* that presses the upper end of the first shutter 63*d* of the front fixing unit 63; holding arms 64*d* that can hold the right and left ends of the second shutter 63*f* of the front fixing unit 63; a contact portion 64*e* that is in contact with the front end of the second shutter 63*f* so as to move the second shutter 63*f* to the open side; lock arms 64*f* that have a U-shape and are engaged with protruding portions 63*g* that protrude from the right and left ends of the front fixing unit 63 of the drawer tray 62; lock-urging tension springs 64*g* that is attached to the lock arm 64*f* at one end; and a vertical hole 64*h* with which the tilted hole 63*c* of the front fixing unit 63 is connected, as illustrated in FIGS. 15 and 18.

Figure 17:
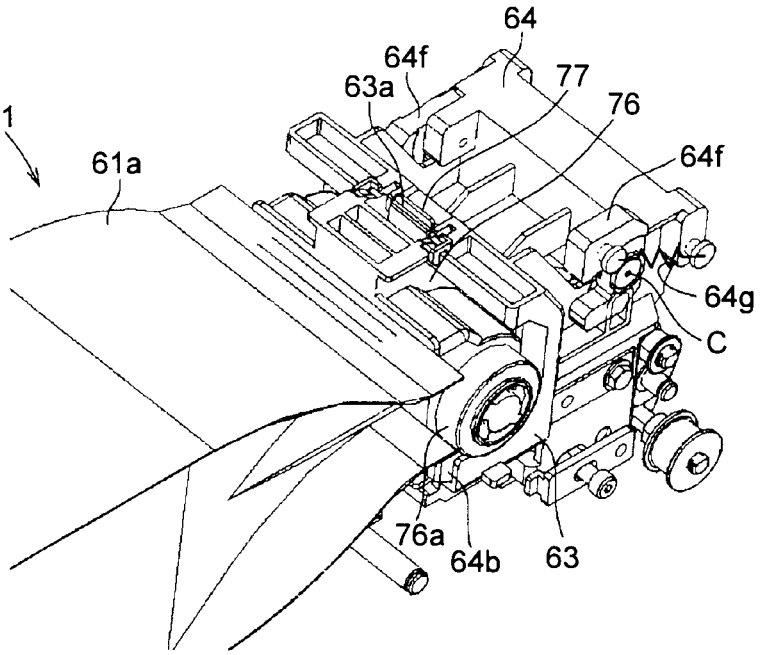
FIG. 17 is a perspective view of the vibrating unit to which the drawer tray is attached.

The lock arms 64*f* are provided as a pair on the right and left sides. Although the right and left lock arms 64*f* are set in the locked state or the unlocked state at the same time, the lock arm 64*f* on the left side and the lock arm 64*f* on the right side are illustrated in FIG. 15 in the locked state and the unlocked state, respectively, for convenience (same in FIG. 17). In the illustrated state, the tension spring 64*g* is removed from the lock arm 64*f* on the left side.

Next, an explanation is given of operations for opening the rotary shutter 71, the first shutter 63*d*, and the second shutter 63*f* when the toner cartridge 61 is mounted on the drawer tray 62, as illustrated in FIG. 14, and the drawer tray 62 is installed in the apparatus body 100. When the drawer tray 62 is installed in the apparatus body 100, the rack on the top surface of the rack bar 64*b* is engaged with the lower side of the gear 73 of the rotary shutter 71 and the gear 73 is rotated in conjunction with the forward-moving and installing operation of the drawer tray 62. At this time, the rotation direction is in a clockwise direction in FIG. 6A and is in a counterclockwise direction in FIG. 14. Because the gear 73 is integrally formed with the rotary shutter 71, the rotary shutter 71 is rotated by about 90° in a clockwise direction in FIG. 6A and the inlet 71*a* of the rotary shutter 71 matches the tilted hole 79 and the outlet 71*b* matches the discharge opening 80, as illustrated in FIGS. 6B and 18. Thus, the rotary shutter 71 is in the open state, whereby the toner in the toner cartridge 61 can be discharge to the outside.

When the drawer tray 62 is installed in the apparatus body 100, the pair of protruding portions 63*g* on the right and left sides of the front fixing unit 63 push forward the lower end portions of the right and left lock arms 64*f* that are brought into upright states by the tension springs 64*g* of the vibrating unit 64 so as to rotate the lock arms 64*f* in a direction, against the tension springs 64*g*, to push down the lock arms 64*f*. When the tension springs 64*g* pass through the rotation support point C of the lock arms 64*f* in accordance with the rotation of the lock arms 64*f*, the lock arms 64*f* lay down themselves to be in a horizontal position due to the tensile force of the tension springs 64*g*, as illustrated in FIG. 16, whereby the protruding portions 63*g* of the front fixing unit 63 are pushed down to be locked. Thus, the drawer tray 62 and the toner cartridge 61 are prevented from being separated from the front fixing unit 63, and the vibration of the vibrating unit 64 is transmitted to the front fixing unit 63 via the lock arms 64*f* and the protruding portions 63*g*.

When the drawer tray 62 is installed in the apparatus body 100, the protruding portion 64*c* of the vibrating unit 64 pushes the upper end of the first shutter 63*d* so as to rotate the first shutter 63*d* against the tension spring 63*e* and open the first shutter 63*d*, as illustrated in FIG. 18. In this open state, the lower end of the first shutter 63*d*, that has closed the inlet of the tilted hole 63*c*, is moved and retracted such that the lower end of the first shutter 63*d* overlaps the inner wall on the upper side of the tilted hole 63*c*, thereby fully opening the inlet of the tilted hole 63*c*.

Furthermore, when the drawer tray 62 is installed in the apparatus body 100, the contact portion 64*e*, which is provided in the lower section on the front side of the vibrating unit 64, pushes the front end of the second shutter 63*f* so as to move the second shutter 63*f* backward with respect to the front fixing unit 63 against a tension spring (not illustrated) so as to open the outlet of the tilted hole 63*c*, as illustrated in FIG. 18. Thus, the tilted hole 63*c* of the front fixing unit 63 is connected with the vertical hole 64*h* of the vibrating unit 64. At this time, the right and left sides of the second shutter 63*f* are held by the pair of holding arms 64*d* on the right and left sides of the vibrating unit 64.

Thus, the inside of the toner cartridge 61 communicates with the vertical hole 64*h* of the vibrating unit 64 through the horizontal hole 78 and the tilted hole 79 of the discharging unit 61*c*, the inlet 71*a* and the outlet 71*b* of the rotary shutter 71, the discharge opening 80 of the discharging unit 61*c*, and the tilted hole 63*c* of the front fixing unit 63. If the delivery member 91 of the drawer tray 62 is operated and the vibrating unit 64 vibrates in the above-described state, the toner in the toner cartridge 61 is discharged through the vertical hole 64*h* of the vibrating unit 64 due to the weight of the toner. Because the outlet of the tilted hole 63*c* of the front fixing unit 63 is provided at a lower level than the discharge opening 80 of the discharging unit 61*c*, the toner is discharged from the discharge opening 80 through the tilted hole 63*c* in a smooth manner due to gravity without remaining inside the tilted hole 63*c*.

When the toner cartridge 61 is to be removed, the lock on the lock arm 64*f*, that is in the state illustrated in FIG. 16, is released and the drawer tray 62 is drawn out of the apparatus body 100. At this time, each of the rotary shutter 71, the first shutter 63*d*, and the second shutter 63*f* is moved in the direction opposite to that described above, i.e., in the closing direction. Specifically, when the drawer tray 62 is drawn out, the gear 73 that is engaged with the rack bar 64*b* is rotated so that the rotary shutter 71 is changed from the open state illustrated in FIG. 6B to the closed state illustrated in FIG. 6A. Thus, the rotary shutter 71 moves upward (against the direction of the gravitational force) with respect to the discharge opening 80, thereby reducing the possibility that the toner provided near the discharge opening 80 may be sandwiched between the rotary shutter 71 and the tubular section 76. Because the rotary shutter 71 is rotated to scoop up the toner in the through-hole 71*f* and because the outlet 71*b* of the rotary shutter 71 is closed by the tubular section 76 while the outlet 71*b* is directed to an upward direction relative to the horizontal direction, leakage of toner that may remain in the through-hole 71*f* of the rotary shutter 71 can be certainly prevented. Because the first shutter 63*d* is no longer pushed by the protruding portion 64*c* due to the drawing operation of the drawer tray 62, the first shutter 63*d* enters the closed state due to the tensile force of the tension spring 63*e*, as illustrated in FIG. 14. The second shutter 63*f* is held by the pair of holding arms 64*d* until the second shutter 63*f* enters the fully closed state by the drawing operation of the drawer tray 62. As soon as the second shutter 63*f* enters the closed state, the rear ends on both sides of the second shutter 63*f* move over the claws on the edges of the holding arms 64*d* so that the holding arms 64*d* move in the directions away from each other (in the right or left direction), thereby allowing the second shutter 63*f* to be separated from the holding arms 64*d*. Due to the operation of closing the second shutter 63*f*, leakage of toner that may remain in the tilted hole 63*c* can be certainly prevented.

An explanation has been given above of the operations of opening and closing the rotary shutter 71, the first shutter 63*d*, and the second shutter 63*f* when the drawer tray 62 is attached or detached, and an explanation will be given below of an operation of the toner conveying device 8.

Figure 19:
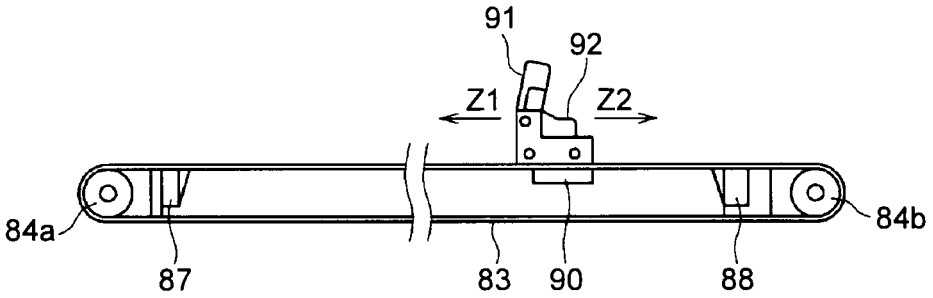
FIG. 19 is a configuration diagram of the toner conveying device.

The rotation direction of the drive belt 83 of the toner conveying device 8 can be changed by two switches 87, 88 that are illustrated in FIG. 19. Each of the switches 87, 88 is provided at a position where the moving direction of the delivery member 91 is changed. Specifically, the switch 87 is provided at the end portion in the delivery direction Z1 of the drawer tray 62 (at the end portion on the left side illustrated in the drawing), and the switch 88 is provided at the end portion in the return direction Z2 of the drawer tray 62 (at the end portion on the right side illustrated in the drawing). When the delivery member 91 reaches one of the positions where the moving direction is changed, the base member 90 is brought into contact with the switch 87 or the switch 88, which is provided at that position. Specifically, the base member 90 functions as an input unit that is brought into contact with each of the switches 87, 88 so as to turn on the switch. A noncontact sensor may be provided instead of a contact-type switch, and a detection-target unit (an input unit) installed on the base member 90, or the like, is provided to be close to the noncontact sensor to turn on the sensor.

Figure 20:
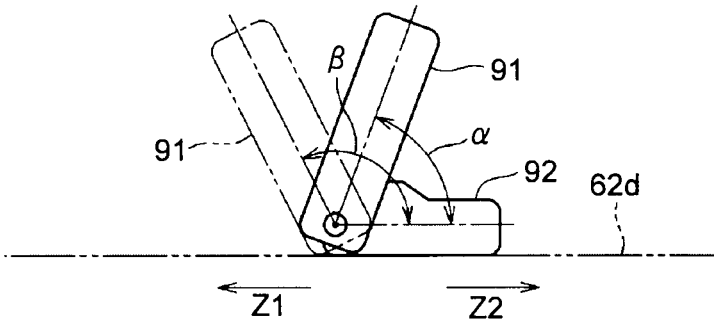
FIG. 20 is a side view of a delivery member and a leg member.

FIG. 20 is a side view of the delivery member 91 and the leg members 92. As illustrated in FIG. 20, the leg members 92 are in contact with a placement surface 62*d* of the drawer tray 62 and can move back and forth in the delivery direction Z1 and the return direction Z2 along the placement surface 62*d*.

Specifically, the placement surface 62*d* also functions as a guide surface for guiding the leg members 92. The delivery member 91 and the leg members 92 are urged by the torsion coil spring in directions to be separated from each other, as described above; however, the leg members 92 is in contact with the placement surface 62*d* so that the leg members 92 is supported in a state to be arranged in a horizontal direction. The delivery member 91 is urged to be rotated and opened in the delivery direction Z1 (toward the discharging unit 61*c*) with respect to the leg members 92 that is supported in a horizontal direction. A regulating unit (not illustrated), such as a stopper, regulates the rotation of the delivery member 91 in the direction in which the delivery member 91 is opened against the urging force of the torsion coil spring. Thus, the delivery member 91 is supported to be in a standing state with respect to the placement surface 62*d* (in the state illustrated by the solid line in the figure). The placement surface 62*d* and the regulating unit cause the open angle between the delivery member 91 and the leg members 92 to be a predetermined angle α so that the delivery member 91 is in a predetermined standing state with respect to the placement surface 62*d*.

In FIG. 20, the open angle β is an angle that is obtained when the delivery member 91 is not regulated by the regulating unit. Specifically, the angle β represents the open angle obtained when the torsion coil spring is in a natural state. As illustrated in FIG. 20, the open angle β, which is retained by the torsion coil spring in the natural state, is set in the range from an angle larger than the open angle α, at which the delivery member 91 is in a predetermined standing state, to an angle smaller than 180°.

Figure 21:
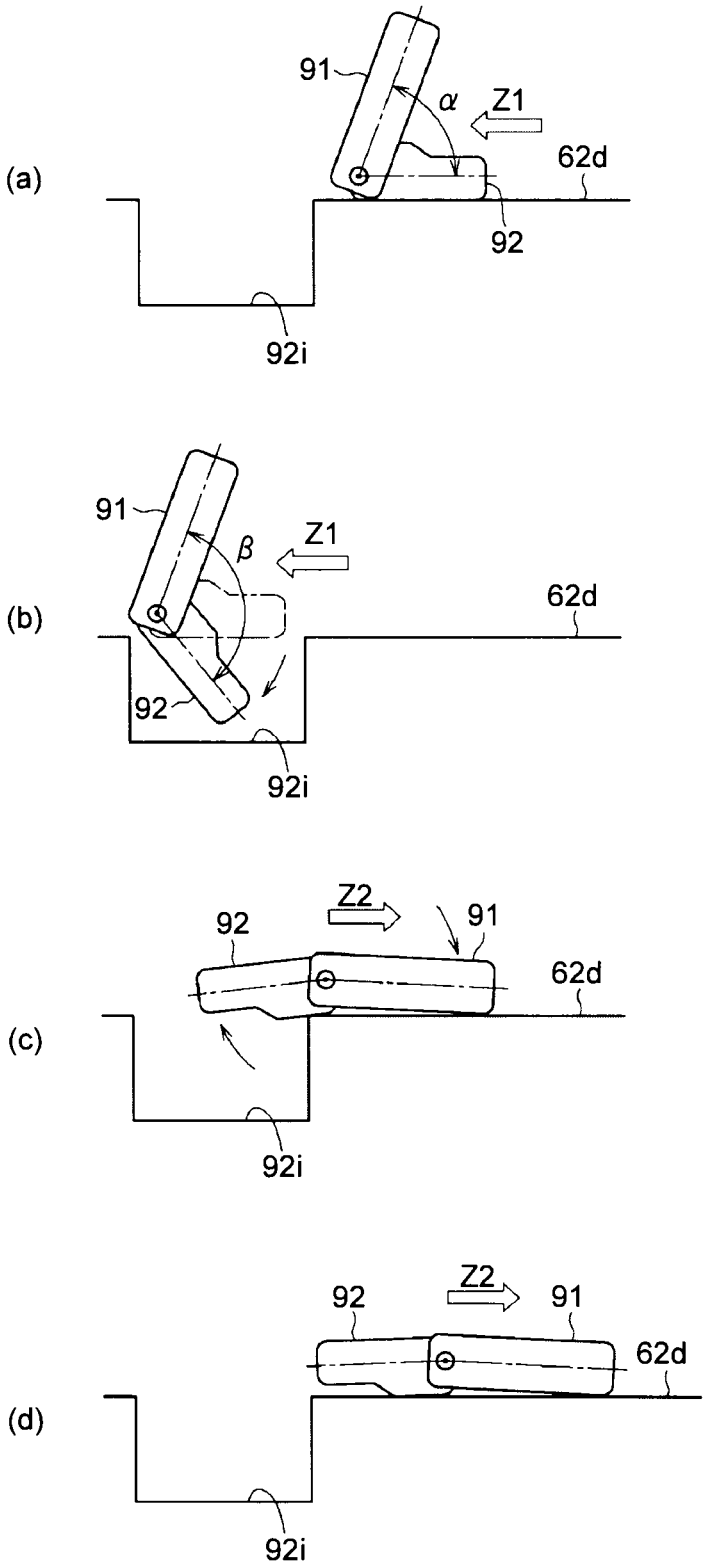
FIG. 21 is a diagram illustrating an operation performed when the standing state of the delivery member is changed to a laid-down state.
Figure 22:
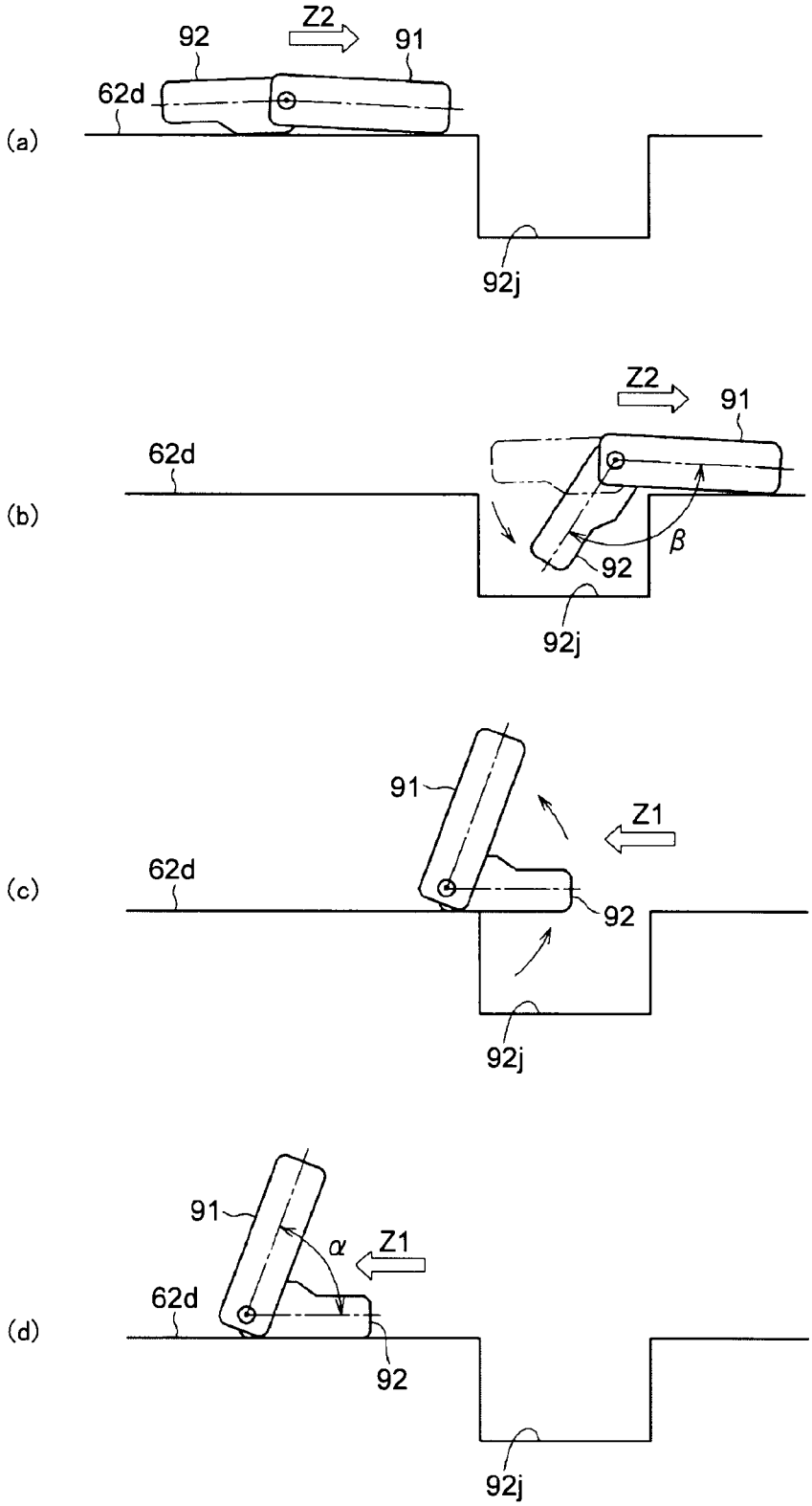
FIG. 22 is a diagram illustrating an operation performed when the laid-down state of the delivery member is changed to the standing state.

As illustrated in FIGS. 21 and 22, recessed portions 92*i*, 92*j*, into which the leg members 92 can enter, are provided at both ends in the direction along which the leg members 92 move in a reciprocating manner (in the delivery direction Z1 and the return direction Z2) on the placement surface 62*d*. According to the present embodiment, proving the recessed portions 92*i*, 92*j* makes the delivery member 91 switchable between the standing state and the laid-down state with respect to the placement surface 62*d*.

With reference to FIGS. 21 and 22, an explanation is given below of a switching operation of the delivery member 91 between the standing state and the laid-down state.

FIG. 21(*a*) illustrates a state before the delivery member 91 reaches the recessed portion 92*i* on the end portion side in the delivery direction Z1. In this state, the open angle between the delivery member 91 and the leg members 92 is kept at the predetermined angle α by the regulating unit (not illustrated) and the placement surface 62*d*, and the delivery member 91 is in a predetermined standing state with respect to the placement surface 62*d*.

As illustrated in FIG. 21(*b*), if the delivery member 91 moves in the delivery direction Z1 and the leg member 92 reaches the position of the recessed portion 92*i*, the leg member 92 is moved downward due to the urging force of the torsion coil spring (not illustrated) because there is no placement surface 62*d* to support the leg member 92 at the position of the recessed portion 92*i*, and the leg member 92 enters the recessed portion 92*i* (see the positions of the recessed portions 92*i* in FIGS. 9A and 9B). The open angle between the delivery member 91 and the leg member 92 is the angle β that is retained by the torsion coil spring in the natural state.

When the delivery member 91 reaches the position of the recessed portion 92*i*, the base member 90 is brought into contact with the switch 87 illustrated in FIG. 19, so that the moving direction of the delivery member 91 is changed.

As illustrated in FIG. 21(*c*), if the moving direction is changed so that the delivery member 91 moves in the return direction Z2, the leg member 92 is brought into contact with the edge portion (near the opening) of the recessed portion 92*i*, and the front end of the leg member 92 is lifted upward. If the leg member 92 is lifted upward and is rotated in the direction in which the leg member 92 is further opened, the open angle becomes larger than the angle β; therefore, the urging force of the torsion coil spring is applied in the closing direction. As a result, the delivery member 91 is laid down onto the placement surface 62*d* by the urging force applying in the closing direction.

As illustrated in FIG. 21(*d*), if the leg member 92 is moved out of the recessed portion 92*i*, the delivery member 91 and the leg member 92 are kept in a horizontally laid-down state on the placement surface 62*d*. Specifically, because the open angle between the delivery member 91 and the leg member 92 is about 180° in the above-described state, the delivery member 91 and the leg member 92 are subjected to the urging force of the torsion coil spring in a direction to close the angle with respect to each other; however, because the rotation of the delivery member 91 and the leg member 92 is regulated by the placement surface 62*d*, the delivery member 91 and the leg member 92 are kept in a horizontally laid-down state. In the meantime, the delivery member 91 and the leg member 92 are configured such that an angle therebetween, with respect to each other, does not exceed 180°.

FIG. 22(*a*) illustrates a state before the delivery member 91, which has been laid down as described above, reaches the recessed portion 92*j* on the end portion in the return direction Z2 (see the position of the recessed portion 92*j* in FIGS. 9A and 9B). In this state, the open angle between the delivery member 91 and the leg member 92 is about 180°, in the same manner as illustrated in FIG. 21(*d*), and the delivery member 91 and the leg member 92 are kept in a horizontally laid-down state.

As illustrated in FIG. 22(*b*), when the leg member 92 reaches the position of the recessed portion 92*j*, the leg member 92 is moved downward by the urging force of the torsion coil spring because there is no placement surface 62*d* to support the leg member 92 at the position of the recessed portion 92*j*, and the leg member 92 enters the recessed portion 92*j*. At this time, the open angle between the delivery member 91 and the leg member 92 is the angle β that is retained by the torsion coil spring in the natural state. Because the delivery member 91 is configured not to enter the recessed portion 92*j*, the delivery member 91 passes over the recessed portions 92*j*.

When the delivery member 91 reaches the position of the recessed portion 92*j*, the base member 90 is brought into contact with the switch 88 illustrated in FIG. 19, so that the moving direction of the delivery member 91 is changed.

As illustrated in FIG. 22(*c*), if the moving direction is changed so that the delivery member 91 moves in the delivery direction Z1, the leg member 92 is brought into contact with the edge (near the opening) of the recessed portion 92*j*, and the front end of the leg member 92 is lifted upward. If the leg member 92 is lifted upward and is rotated in the direction in which the leg member 92 is further closed, the open angle becomes smaller than the angle β, and therefore the urging force of the torsion coil spring is applied in the opening direction. As a result, the delivery member 91 is made to stand up by the urging force applying in the opening direction.

As illustrated in FIG. 22(*d*), if the leg member 92 is moved out of the recessed portion 92*j*, the delivery member 91 is kept in a state in which the delivery member 91 stands up at the predetermined open angle α.

Although the embodiment of the present invention has been explained above, the present invention is not limited thereto and various changes can be obviously made without departing from the scope of the present invention. In the above-described embodiment, the entire housing unit 61*a* is made of deformable material; however, only an area that is to be pushed by the delivery member 91 may be made of deformable material. The gear 73 of the rotary shutter 71 may be directly engaged with the rack bar 64*b*, or one or more intermediate gears may be interposed between the gear 73 and the rack bar 64*b*. The configuration of the present embodiment can be used in a powder container that contains powder other than toner or in a powder conveying device that includes a powder container. The powder conveying device according to the present embodiment can be installed not only in the printer illustrated in FIG. 1 but also in another printer, a copying machine, facsimile, multifunction peripheral, or the like.

As described above, according to the embodiment, because the rotary shutter is provided within the discharge opening of the discharging unit in the powder container and the rotary shutter is rotatable in the discharge opening, there is no need to provide space outside the powder container for opening and closing the rotary shutter; therefore, it is suitable for reduction in the space or the size of the image forming apparatus. An unused toner cartridge can be installed in the image forming apparatus by keeping the rotary shutter closed, and the rotary shutter can be opened in conjunction with the installation operation. Conversely, when a used toner cartridge is removed, the rotary shutter can be closed in conjunction with the removing operation. Thus, it is possible to prevent the leakage of powder and prevent contamination due to toner.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A powder container comprising:
a housing unit that is horizontally elongated, contains powder, and has at least a deformable part thereof; and
a discharging unit that is attached to one end of the housing unit in a longitudinal direction, wherein
the discharging unit includes
a discharge opening through which the powder in the housing unit is discharged outside and
a rotary shutter
that is provided inside the discharge opening and
that opens and closes the discharge opening by rotating about a rotating shaft that is arranged perpendicular to the longitudinal direction of the housing unit,
wherein a downstream end of the discharge opening is provided below an upstream end of the discharge opening,
wherein the rotating shaft of the rotary shutter passes through a side wall of the discharging unit and protrudes outwardly, and
wherein a gear that rotates the rotary shutter is attached to a protruding end of the rotating shaft.

2. The powder container according to claim 1, wherein
the rotary shutter includes a through-hole that communicates with the discharge opening when the rotary shutter is at an open position and the through-hole forms a discharge path that is tilted downward on a front side when the rotary shutter is at the open position.

3. The powder container according to claim 2, wherein
a downstream end of the through-hole is directed upward relative to a horizontal plane when the rotary shutter is at a closed position and the downstream end of the through-hole is directed downward relative to the horizontal plane when the rotary shutter is at the open position.

4. The powder container according to claim 2, wherein
a sealing member that seals a gap between an outer circumference of the rotary shutter and an inner surface of the discharge opening of the discharging unit is attached to the outer circumference of the rotary shutter at least around the through-hole.

5. The powder container according to claim 1, wherein
at least a side surface and an upper portion of an outer circumference of the gear are covered by a cover that extends from a side wall of the discharging unit.

6. A toner cartridge that uses the powder container according to claim 1.

7. An image forming apparatus comprising the toner cartridge according to claim 6 in an attachable and detachable manner.

8. A powder container comprising:
a housing unit that is horizontally elongated, contains powder, and has at least a deformable part thereof; and
a discharging unit that is attached to one end of the housing unit in a longitudinal direction, wherein
the discharging unit includes
a discharge opening through which the powder in the housing unit is discharged outside and
a rotary shutter
that is provided inside the discharge opening and
that opens and closes the discharge opening by rotating about a rotating shaft that is arranged perpendicular to the longitudinal direction of the housing unit,
wherein the rotary shutter includes a through-hole that communicates with the discharge opening when the rotary shutter is at an open position and the through-hole forms a discharge path that is tilted downward on a front side when the rotary shutter is at the open position.

9. The powder container according to claim 8, wherein a downstream end of the through-hole is directed upward relative to a horizontal plane when the rotary shutter is at a closed position and the downstream end of the through-hole is directed downward relative to the horizontal plane when the rotary shutter is at the open position.

10. The powder container according to claim 8, wherein
a sealing member that seals a gap between an outer circumference of the rotary shutter and an inner surface of the discharge opening of the discharging unit is attached to the outer circumference of the rotary shutter at least around the through-hole.

11. The powder container according to claim 8, wherein
the rotating shaft of the rotary shutter passes through a side wall of the discharging unit and protrudes outwardly and
a gear that rotates the rotary shutter is attached to a protruding end of the rotating shaft.

12. The powder container according to claim 11, wherein
at least a side surface and an upper portion of an outer circumference of the gear are covered by a cover that extends from a side wall of the discharging unit.

13. An image forming apparatus comprising the powder container according to claim 8 in an attachable and detachable manner.

14. An image forming apparatus comprising a powder container, the powder container including:

a housing unit that includes powder; and a discharging unit that is attached to the housing unit, wherein the discharging unit includes:

a discharge opening through which the powder in the housing unit is discharged outside; and a rotary shutter that opens and closes the discharge opening by rotating, wherein a downstream end of the discharge opening is below an upstream end of the discharge opening, the powder container mounted to the image forming apparatus in a detachable manner, the image forming apparatus further comprising:

a drawer tray in which the powder container is mounted, the drawer tray including:

a fixing unit to which the discharging unit of the powder container is mounted, a tilted hole, inside of the fixing unit, to be connected to the discharge opening of the powder container when the discharging unit of the powder container is mounted in the fixing unit, a first shutter, at an inlet side of the tilted hole, to open and close the inlet of the tilted hole, and a second shutter, at an outlet side of the tilted hole, to open and close the outlet of the tilted hole, wherein the tilted hole is tilted such that the outlet side is lower than the inlet side.

15. The image forming apparatus according to claim 14, wherein:

the housing unit includes at least a deformable part thereof.

16. The image forming apparatus according to claim 14, wherein:

the rotary shutter is inside the discharge opening and includes:

a rotational axis which is perpendicular to an attaching direction of the powder container, and an elongated shape in a direction of the rotational axis.

17. The image forming apparatus according to claim 14, wherein:

the first shutter and the second shutter are opened in conjunction with an installation operation for installing the drawer tray into the image forming apparatus.

* * * * *